US011679402B2

(12) United States Patent
Goettke

(10) Patent No.: US 11,679,402 B2
(45) Date of Patent: Jun. 20, 2023

(54) DISPENSER FOR COMPOUNDS IN PASTE FORM

(71) Applicant: RPC Bramlage GmbH, Lohne (DE)

(72) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 27 days.

(21) Appl. No.: 17/602,031

(22) PCT Filed: Apr. 8, 2020

(86) PCT No.: PCT/EP2020/060016
§ 371 (c)(1),
(2) Date: Oct. 7, 2021

(87) PCT Pub. No.: WO2020/208073
PCT Pub. Date: Oct. 15, 2020

(65) Prior Publication Data

US 2022/0176397 A1 Jun. 9, 2022

(30) Foreign Application Priority Data

Apr. 9, 2019 (GB) ..... 1905042
May 29, 2019 (DE) ..... 10 2019 114 544.9
Oct. 7, 2019 (GB) ..... 1914419

(51) Int. Cl.
*B05B 11/00* (2023.01)
*B05B 11/10* (2023.01)
*B05B 11/02* (2023.01)

(52) U.S. Cl.
CPC ..... *B05B 11/1033* (2023.01); *B05B 11/0032* (2013.01); *B05B 11/026* (2023.01); *B05B 11/028* (2023.01)

(58) Field of Classification Search
CPC ..... B05B 11/3033; B05B 11/0032; B05B 11/00412; B05B 11/00416; B05B 11/1033; B05B 11/026; B05B 11/028
See application file for complete search history.

(56) References Cited

U.S. PATENT DOCUMENTS 6,712,243 B2 3/2004 Rossignol
7,819,290 B2 10/2010 Behar
(Continued)

FOREIGN PATENT DOCUMENTS

CN 101821015 A 9/2010
CN 102026735 A 4/2011
(Continued)

OTHER PUBLICATIONS

International Search Report of PCT/EP2020/060016, dated Jul. 16, 2020.

*Primary Examiner* — Frederick C Nicolas
(74) *Attorney, Agent, or Firm* — Collard & Roe, P.C.

(57) ABSTRACT

A dispenser for compounds in paste form has a storage volume with a bounding part that can move conjointly when drawing from the storage volume, and a head piece that is guided relative to the storage volume. A discharge chamber with an inlet valve and an outlet valve has a discharge channel with a discharge opening. A spring element is active between the storage volume and the head piece, forms a bounding wall of the discharge chamber, and has a lower ear-shaped plug projection and an upper retaining profile. The spring element is designed as a leg that connects to the plug projection, which leg transitions into the retaining projection via an upwardly curved portion. The retaining profile is designed as a retaining projection that has a larger cross section than the leg, with an upper projection base which is enclosed in the retaining recess.

28 Claims, 20 Drawing Sheets

(56) References Cited

U.S. PATENT DOCUMENTS

| | | | | |
|---|---|---|---|---|
| 9,096,362 | B2 | 8/2015 | Von Schuckmann | |
| 2010/0206910 | A1 | 8/2010 | Carta | |
| 2010/0294805 | A1 | 11/2010 | Pohlmann et al. | |
| 2011/0031282 | A1 | 2/2011 | Hagen | |
| 2012/0024904 | A1* | 2/2012 | Doulin | B05B 11/3061 222/207 |
| 2014/0239017 | A1* | 8/2014 | Von Schuckmann | B05B 11/309 222/207 |
| 2016/0325297 | A1 | 11/2016 | Goettke | |
| 2018/0056314 | A1 | 3/2018 | Schroeder | |

FOREIGN PATENT DOCUMENTS

| | | | |
|---|---|---|---|
| CN | 105934281 | A | 9/2016 |
| CN | 107428442 | A | 12/2017 |
| CN | 107484413 | A | 12/2017 |
| DE | 10 2008 029 004 | A1 | 1/2009 |
| EP | 2 747 893 | A1 | 7/2014 |
| EP | 2 164 645 | B1 | 10/2014 |
| WO | 01/91913 | A1 | 12/2001 |
| WO | 2013/026769 | A1 | 2/2013 |
| WO | 2016/174031 | A1 | 11/2016 |

* cited by examiner

1
IV
63
64
E
36
28
2
3
32
35
30
31
33
20
4
42
19
43
x
21
45
37
25
40
41
23
24
44
U
34
18
29
17
22
27
26
12
E
a
f
e
b
d
c
10
M
16
38
13
14
x
15
11

1
31
30
U
XI
29
17
64
18
61
48
2
3
10
52
53
58
55
4
45
19
M
x
54
50
21
56
20
41
23
24
51
35
62
34
63
28
36
47
27
22
57
12
38
13
14
43
x
42
15
16
26
11

DISPENSER FOR COMPOUNDS IN PASTE FORM

CROSS REFERENCE TO RELATED APPLICATIONS

This application is the National Stage of PCT/EP2020/060016 filed on Apr. 8, 2020, which claims priority under 35 U.S.C. § 119 of Great Britain Application No. 1905042.6 filed on Apr. 9, 2019, German Application No. 10 2019 114 544.9 filed on May 29, 2019, and Great Britain Application No. 1914419.5 filed on Oct. 7, 2019, the disclosures of which are incorporated by reference. The international application under PCT article 21(2) was not published in English.

TECHNICAL FIELD

The invention pertains to a dispenser for pasty compounds consisting of a storage volume with a delimiting part, which can be moved conjointly when drawing from the storage volume, and a head piece that is guided relative to the storage volume, wherein a discharge chamber with an inlet valve and an outlet valve is formed between the head piece and the storage volume, wherein a discharge channel with a discharge opening furthermore is assigned to the discharge chamber, wherein a spring element, which acts between the storage volume and the head piece and at the same time forms part of a delimiting wall of the discharge chamber, is provided in order to resiliently return the head piece upon a movement from a starting position into an actuation position, wherein said spring element has, viewed in a cross section in which the head piece is arranged vertically on the top and the storage volume is arranged vertically on the bottom and a central longitudinal axis of the dispenser is illustrated in the form of a line, a lower tubular plug projection, which is accommodated in a conformingly shaped plug receptacle connecting to the storage volume in a sealed manner, and an upper retaining profile, which is accommodated in a retaining receptacle of the head piece in a sealed manner, and wherein the spring element is, if the spring element is designed integrally with the retaining projection and the plug projection, referred to the cited cross section in the starting position realized in the form of a leg, which is designed so as to connect to the plug projection and transforms into the retaining projection via an upwardly directed curvature.

PRIOR ART

Dispensers of the type in question particularly serve for dispensing pasty compounds in a portioned manner, e.g. for dispensing cream such as moisturizing cream or toothpaste, wherein a delimiting part, which can be moved conjointly and is realized, e.g., in the form of a follower piston may be provided in a storage volume accommodating the compound. The compound is dispensed in a portioned manner due to a pumping movement of the head piece relative to the storage volume. In this context, we refer, for example, to EP 2 747 893 B1 (U.S. Pat. No. 9,096,362 B2). This patent specification discloses a dispenser of the type in question, in which a spring element captured between the head piece and the storage volume is tensioned when the head piece is lowered in a user-actuated manner in order to dispense the compound. When the user ceases to exert pressure upon the head piece, the head piece is displaced back into the starting position as a result of the previously generated restoring force of the spring element. With respect to a vertical section or with respect to a cross section, in which the head piece is arranged vertically on the top and the storage volume is arranged vertically on the bottom, the spring element has in the starting position and in the actuation position a U-shaped section, which extends freely in a [text missing] between the storage volume and a circumferential wall of the head piece. A dispenser of this type is also known, for example, from U.S. Pat. No. 7,819,290 B2.

EP 2 164 645 B1 discloses a dispenser of this type, in which the spring element is realized similar to a bellows, wherein a lip section is integrally formed on the head piece and forms the outlet valve in interaction with the spring element.

In a dispenser known from WO 01/91913 A1, a thickened region of the membrane part serves as a stop on a lower edge of a head part. The valve is realized on a separate part.

In a dispenser known from WO 2013/026769 A1, a retaining profile with the same cross section as the membrane design is furthermore provided. The valve section is viewed from outside realized in the form of a consistently convex section.

DE 10 2008 029 004 A1 discloses a dispenser for pasty compounds, in which an outlet valve is realized independently of and at a distance from the retaining projection. The valve projection essentially is designed in the form of a conically tapered section.

SUMMARY OF THE INVENTION

Based on the above-described the prior art, the invention aims to disclose a dispenser for discharging pasty compounds, in which the spring element has an advantageous design and at the same time allows a sound discharge characteristics and/or retention in the dispenser.

This objective is initially attained with one aspect of the invention, according to which it is proposed that the retaining profile is realized in the form of an altogether annular retaining projection, which in terms of cross section is larger than the leg and has an upper projection base that lies in the retaining receptacle and has a closed cross section, that a valve section is integrally formed on the retaining projection in order to realize the outlet valve, and that the valve section has a concave profile on its radially outer side facing the discharge channel.

The objective is furthermore attained with a further object of the invention, according to which it is proposed that the retaining profile is realized in the form of an altogether annular retaining projection, which in terms of cross section is larger than the leg and has an upper projection base that lies in the retaining receptacle and has a closed cross section, that the retaining receptacle of the head piece for accommodating the retaining projection is realized in the form of a groove that is open vertically downward, that the retaining projection engages into the circumferential groove of the head piece, which is open vertically downward, and that the projection base of the retaining projection is axially spaced apart from a facing groove base of the groove with respect to its end face that is directed upward at a ceiling section.

This objective is also attained with a further object of the invention, according to which it is proposed that the retaining profile is realized in the form of an altogether annular retaining projection, which in terms of cross section is larger than the leg and has an upper projection base that lies in the retaining receptacle and has a closed cross section, and that the leg transforms into the retaining projection via a hinge-like taper.

This objective is ultimately also attained with a further object of the invention, according to which it is proposed that the retaining profile is realized in the form of an altogether annular retaining projection, which in terms of cross section is larger than the leg and has an upper projection base that lies in the retaining receptacle and has a closed cross section, and that the retaining projection forms a projection leg, which with respect to a transition area between the upward leg and the retaining projection protrudes vertically downward and with respect to the central longitudinal axis of the dispenser extends radially outward to the upward leg starting from the transition area.

According to a preferred embodiment, the upward leg may transform into the retaining projection via a hinge-like taper. The taper may be formed by realizing a region thinner than adjoining regions, e.g. the upward leg and the transition area. In this way, a material taper offering a hinge-like effect between upward leg and transition area can be formed. In this case, a material thickness in the region of the hinge-like taper may correspond to approximately 0.3-times to 0.8-times, e.g. to approximately 0.5-times, the thickness of the adjoining spring element regions such as the transition area and/or the upward leg.

The retaining projection may form a projection leg, which with respect to a transition area between the upward leg and the retaining projection protrudes vertically downward and with respect to the vertical central longitudinal axis of the dispenser extends radially outward to the upward leg starting from the transition area. In this case, the projection leg may serve for the retaining accommodation in the retaining receptacle of the head piece, if applicable, together with the retaining projection. According to a potential embodiment, the projection leg may interact with the retaining receptacle in a frictionally engaged and/or form-fitting manner in the region of a resulting radially outer circumferential surface.

According to a potential embodiment, the retaining receptacle of the head piece for accommodating the retaining projection—and optionally the additional projection leg—may be realized in the form of a groove that is open vertically downward. According to the initially described cross section, this groove essentially may be realized in a U-shaped manner, wherein the corresponding U-opening, through which particularly the retaining projection of the spring element penetrates into the retaining receptacle, is directed vertically downward.

The retaining receptacle furthermore may have a groove base that closes the retaining receptacle vertically upward similar to a ceiling. In an essentially U-shaped design of the respective groove or retaining receptacle, this groove base is the U-crosspiece connecting the U-legs, which in a cross section essentially extend parallel to one another.

The retaining projection may extend vertically upward starting from the transition area. According to a potential embodiment, the hinge-like taper therefore may be formed in a transition from the retaining projection into the projection leg. In another embodiment, the extent of the retaining projection as such in the radial direction may be greater than the extent of the projection leg in the same direction. In this case, the corresponding radial thickness of the retaining projection may correspond to approximately 1.5-times to approximately 2-times the radial thickness of the projection leg.

The retaining projection can also engage into the circumferential groove that is open vertically downward.

In another potential embodiment, the projection leg and the retaining projection may jointly form a circumferential outer wall of the spring element for interacting with an inner groove surface of the retaining receptacle.

The groove may with respect to a cross section have two sidewalls of approximately identical length in the vertical direction. In this respect, however, a design with sidewalls of different lengths in the vertical direction is preferred. In a potential embodiment, the radially outer sidewall may extend vertically downward starting from the groove base or the U-crosspiece by a shorter length than the radially inner sidewall. In a preferred design, however, the radially inner sidewall referred to the central axis is realized shorter than the radially outer sidewall. In this case, the vertical dimension of the longer sidewall starting from the groove base may correspond to approximately 1.5-times to approximately 2.5-times, furthermore to approximately 2-times, the vertical length of the shorter sidewall.

According to another potential embodiment, the radially outer sidewall may protrude vertically downward beyond the projection leg. Accordingly, the projection leg optionally can abut on the facing inner surface of the radially outer sidewall over its entire surface, particularly with respect to its radially outer circumferential surface.

According to a potential embodiment, the radially inner sidewall may with respect to its vertical extent end in the transition area. The hinge-like taper preferably is exposed in such a design of the radially inner sidewall. The radially inner sidewall, in particular, preferably does not represent an obstacle with respect to the mobility in the region of the hinge-like taper in this case.

In a potential embodiment, a radially measured wall thickness of the plug projection interacting with the plug receptacle of the storage volume may approximately correspond to at least 1.5-times the greatest thickness in the region of the horizontally extending leg of the spring element. For example, the wall thickness of the plug projection in the radial direction may correspond to approximately 2-times and up to approximately 3-times the greatest vertically measured thickness in the region of the leg in the starting position.

An axial length of the plug projection starting from a lower edge of the horizontally extending leg in the starting position also may be equal to or greater than the axial extent of the spring element from the aforementioned lower edge of the horizontally extending leg to the axially upper end of the retaining projection. For example, the plug projection may have an axial length that corresponds to approximately 1.0-times to 2-times, e.g. to approximately 1.1-times to 1.5-times, the axial extent of the spring element.

In addition, a valve section may be integrally formed on the retaining projection in order to realize the outlet valve. In this case, the valve section may freely protrude over a vertically upper end of the retaining projection, e.g. in a tab-like manner, in order to close a discharge opening of the discharge chamber, which connects the discharge chamber to the discharge channel. The valve section is pivoted out of its sealing position in a tab-like manner as the head piece is lowered and the pressure in the discharge chamber increases in order to release the discharge opening. Due to its elastic resilience, the valve section drops back into the sealing position as the pressure application decreases upon completion of the downward movement of the head piece.

In another potential embodiment, the valve section may also be realized over a greater circumferential section of the retaining projection than that corresponding to a circumferentially greatest clear opening dimension of an outlet opening of the discharge channel adjacent to the retaining projection. In such an embodiment, the circumference of the valve section accordingly may be designed larger than necessary for the valve-like interaction with the discharge channel. This provides technical advantages, particularly with respect to the assembly. Due to the preferred excess width of the valve section in the circumferential direction, no exact orientation is required in the course of the assembly of the dispenser part comprising the retaining projection with the valve section. In fact, it may in this case suffice to arrange the corresponding dispenser part relative to the discharge channel in such a way that part of the valve section can interact with the discharge channel or the discharge opening in a valve-like manner.

For example, the valve section may extend over one-third or more of the circumference of the retaining projection, e.g. over half or more and up to three-fourths or two-thirds or more of the circumference.

According to a preferred embodiment, the valve section may be designed such that it extends annularly over the circumference in a uniform and closed manner. This allows a free orientation of the dispenser part comprising the valve section in the course of the assembly.

The head piece of the dispenser accommodating the retaining projection may in this case form a groove, particularly for accommodating the valve section in the circumferential direction outside the discharge channel. The valve section, which in this case preferably is designed such that it extends annularly over the circumference in a uniform and closed manner, exits the discharge channel in the circumferential direction on both sides and is accommodated in the aforementioned groove-like receptacle outside the discharge channel.

In another potential embodiment, the retaining projection may directly or indirectly interact with a lip section of the head piece in order to realize the outlet valve. The lip section may form part of the head piece that is designed to be yield under a pressure load, e.g. in a pivotable manner. For example, the lip section may be realized in an elastically resilient manner as a result of a corresponding material selection and/or material thickness.

With respect to the cross section, the lip section may in this case extend radially outward in a freely protruding manner starting from a radially inner retaining region. The lip section furthermore may be designed in the form of a freely protruding flat part, optionally in the form of a uniform and closed annular flat part.

According to a preferred embodiment, the lip section may be designed such that it essentially extends horizontally in the cross section. Such a horizontal alignment particularly may be realized in a preassembly state. In a potential embodiment, the lip section in interaction with the retaining projection for realizing the outlet valve may also be oriented along a horizontal plane in the closed valve position, e.g. under inclusion of an acute angle of a few angular degrees such as 1° to 5°, e.g. 2° or 3°.

In the open valve position, the corresponding acute angle relative to a horizontal plane extending transverse to the central longitudinal axis of the dispenser may be increased. For example, an acute angle up to 10° or up to 20° may be adjusted in the open valve position.

The lip section may interact with a supporting surface of the retaining projection, which is exposed vertically upward. In this respect, a direct interaction between the supporting surface of the retaining projection and a facing surface of the lip section may be realized.

In another preferred embodiment, an annular projection, on which the lip section lies in a sealing manner in the closed valve position, may be formed on the end face such that a point support of the lip section can be realized in a cross section.

The valve formed due to the contact of the lip section with the head piece or with the annular projection of the head piece preferably can be realized over the entire circumference of the retaining projection. Accordingly, the lip section can viewed over the circumference at least partially lift off the retaining projection or the annular projection of the retaining projection when a pressure load in the discharge chamber is exceeded in order to thereby allow the discharge of the portioned compound from the discharge chamber into the discharge channel. In this case, the lip section can also lift off the retaining projection or the annular projection at multiple locations over the circumference in regular or irregular distribution, but furthermore also completely over the entire circumference with uniform or non-uniform vertical spacing from the seal seat.

The lip section may be formed on a plug part arranged in the head piece. The plug part initially may be present in the form of a loose part in the course of the assembly. Furthermore, such a plug part and preferably also the other parts of the dispenser may be manufactured in a plastic injection moulding process.

In another embodiment, the lip section may transform radially inward into a circumferential ring section, which with respect to the cross section protrudes vertically downward beyond the lip section. Such a ring section may be suitable for reducing the volume of the discharge chamber in the depressed state of the head piece. Furthermore, such a ring section may penetrate, e.g., into a U-section of the leg of the spring element, which in the unloaded position essentially extends vertically, and essentially fill out this corrugation-like space being formed in the depressed state of the head piece.

The lip section or the plug part comprising the lip section may consist of a rigid plastic. For example, PE or TPE may be used in this respect and optionally also with respect to the other dispenser parts, preferably with the exception of the spring element.

In another embodiment, the horizontally extending leg may be realized integrally with the inlet valve. The inlet valve may likewise intact with a corresponding inlet opening between the storage volume and the discharge chamber in a tab-like manner, but preferably in an approximately plug-like manner.

According to another preferred embodiment, the spring element may be realized integrally and uniformly in material with the inlet valve and the outlet valve, as well as with the retaining projection, the projection leg and the plug projection.

The head piece may be guided in a stop-limited manner on an insert part facing the storage volume. This stop limitation preferably concerns the normal head piece position, in which no dispenser actuation takes place, and/or the lowered head piece position for discharging the compound. In this case, the guidance and/or the stop limitation preferably can be realized by means of partial regions, which optionally are integrally formed directly on the head piece and/or the insert part.

According to a preferred embodiment, a guidance and a stop limitation furthermore may be assigned to different components of the head piece and the insert part. In this case, components of the head piece and the insert part preferably can serve solely for the guidance of the head piece on the insert part and other components of the head piece and the insert part preferably can serve solely for the stop limitation. This can provide advantages with respect to the manufacture of the dispenser, particularly with respect to the installation of the head piece on the insert part. In the course of the assembly, for example, the local separation of guidance and stop limitation already makes it possible to achieve a guidance in the axial direction before the components are moved into an effective position relative to one another in order to realize the stop limitation.

In a potential embodiment, the insert part accordingly may have a first cylinder section that interacts with a second cylinder section of the head piece in order to realize the guidance. This preferably concerns circular-cylindrical cylinder sections, which preferably are aligned concentric to one another, wherein the first cylinder section of the insert part is with respect to the central longitudinal axis of the dispenser arranged, for example, radially inside of the second cylinder section of the head piece. A reversed arrangement in this respect is also possible.

The insert part may have a third cylinder section, which serves for the snap-in engagement with the volume and furthermore can interact with a fourth cylinder section of the head piece in order to realize the stop limitation. For example, the fourth cylinder section may with respect to the central longitudinal axis of the dispenser also be arranged radially inside in this case and the third cylinder section of the insert part accordingly may be arranged radially outside of the fourth cylinder section of the head piece. A reversed arrangement in this respect is likewise possible in this case.

According to a preferred embodiment, the third and fourth cylinder sections of the insert part and the head piece, which serve for realizing the stop limitation, may be arranged radially outside of the first and second cylinder sections, which serve for realizing the guidance. A reversed arrangement is also possible in this case such that the stop limitation may be arranged radially inside of the guidance.

The head piece may be guided in a stop-limited manner on an insert part facing the storage volume. This stop limitation preferably concerns the normal head piece position.

With respect to the disclosure, the ranges or value ranges or multiple ranges indicated above and below also include all intermediate values, particularly in 1/10 increments of the respective dimension, but optionally also dimensionless. For example, the indication 1.1-times to 1.5-times also includes the disclosure of 1.2-times to 1.5-times, 1.1-times to 1.4-times, 1.2-times to 1.4-times, etc. This disclosure may on the one hand serve for defining a lower and/or upper limit of a cited range, but alternatively or additionally also for disclosing one or more singular values from a respectively indicated range.

BRIEF DESCRIPTION OF THE DRAWINGS

The invention is described in greater detail below with reference to the attached drawings that, however, merely show exemplary embodiments. A component, which is merely described with reference to one of the exemplary embodiments and not replaced with a different component in another exemplary embodiment, is therefore also described as a potentially existing component in this other exemplary embodiment. In the respective drawings:

FIG. 7 shows another perspective view of the spring element;

DESCRIPTION OF THE EMBODIMENTS

Figure 1:
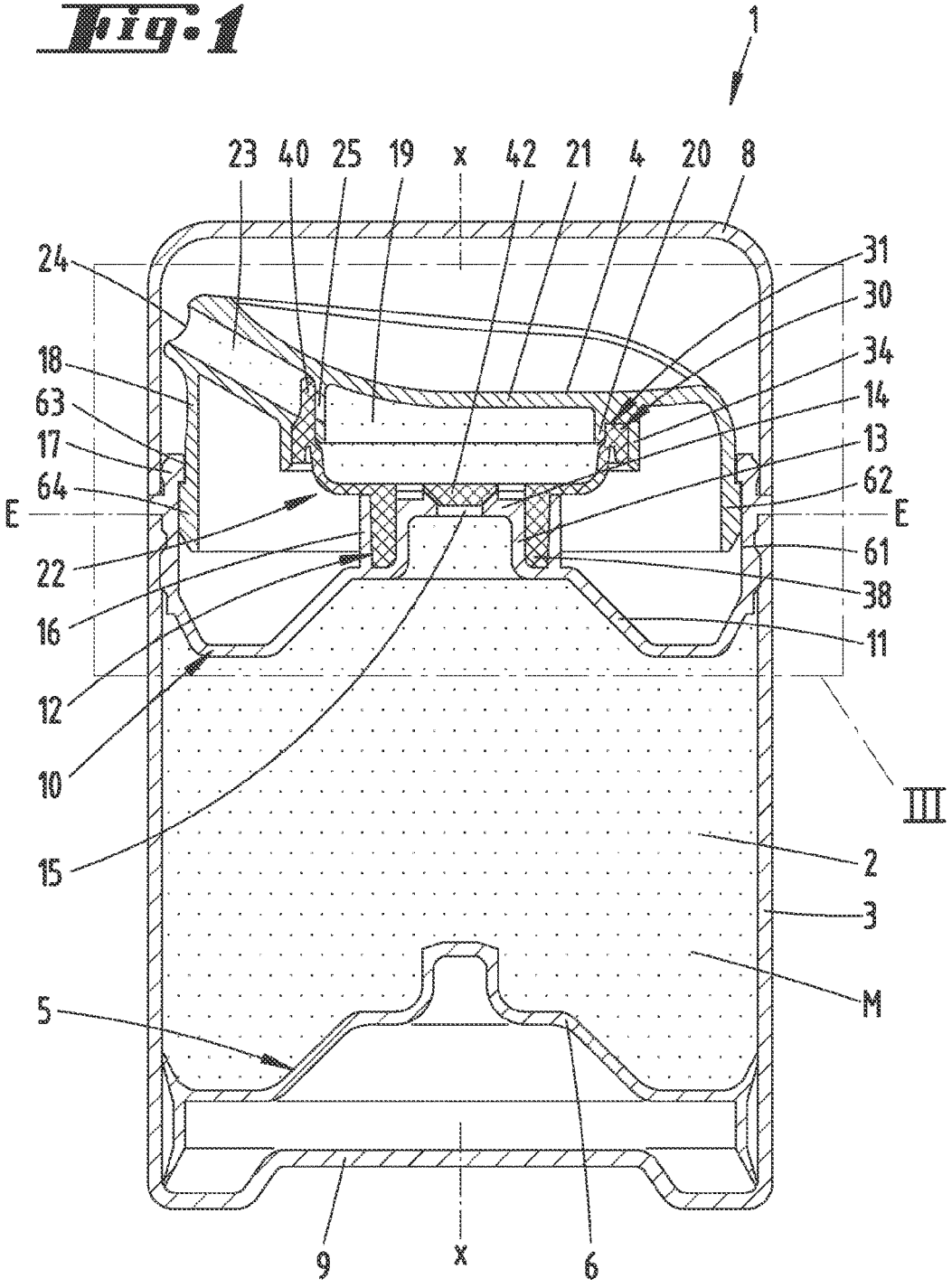
FIG. 1 shows a vertical section through a dispenser of the type in question with a delimiting part in the form of a follower piston, which can be moved conjointly in a storage volume.

A dispenser 1, particularly for discharging a pasty compound M, is initially described with reference to FIGS. 1 and 2.

The dispenser 1 essentially is composed of a compound container 3 that delimits a storage volume 2 and a head piece 4 that can be displaced relative to this compound container 3.

In the preferred embodiment shown, the dispenser 1 is designed rotationally asymmetrical with a central axis x.

The head piece 4 preferably can be displaced relative to the compound container 3 or the storage volume 2 along the central axis x.

According to the exemplary embodiment illustrated in FIGS. 1 to 7, a conjointly movable delimiting part 5 in the form of a follower piston 6 may be provided in the storage volume 2. According to the illustration in FIG. 2, the delimiting part 5 may alternatively also be formed by a compressible bag 7, which at the same time forms the storage volume 2.

Figure 2:
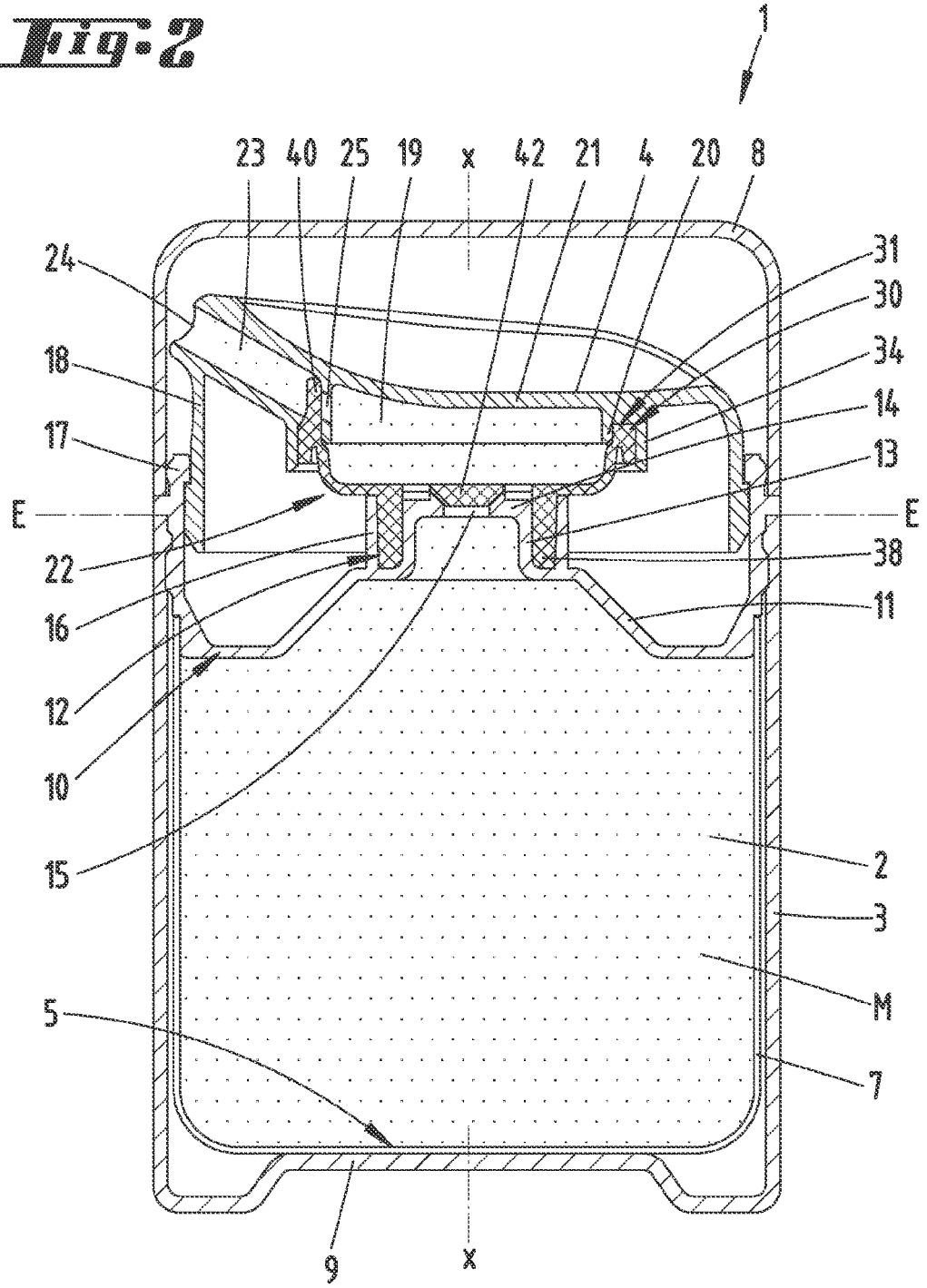
FIG. 2 shows an illustration that corresponds to FIG. 1, wherein the conjointly movable delimiting part is formed by a compressible bag, which furthermore also forms the storage volume.

In the unused position of the dispenser 1 according to the illustrations in FIGS. 1 and 2, the head piece 4 preferably can be covered by a closing cap 8. This closing cap may have an outside diameter that corresponds to the outside diameter of the compound container 3.

The compound container 3 may have a housing bottom 9. The opening of the compound container 3, which in the illustrations is directed vertically upward, is covered by an insert part 10 that in the normal operating state of the dispenser 1 is connected to the compound container 3, particularly by means of a snap-in connection, such that it cannot be separated or at least not separated without a tool.

According to the exemplary embodiment illustrated in FIG. 1, the compound M is stored in the storage volume 2 that is delimited by the follower piston 6 and the insert part 10, as well as by the circumferential wall of the compound container 3. If a bag 7 is used according to the illustration in FIG. 2, the compound M is accommodated in the storage volume 2 that is delimited by the bag 7 on its bottom and its circumference, as well as by the insert part 10 on its upper side.

The insert part 10 may centrally form a plug receptacle 12 that approximately extends as far as the opening plane E of the compound container 3 starting from a conical region 11. This plug receptacle may initially comprise a central pot-like elevation that circumferentially extends concentric to the central axis x as shown, wherein said pot-like elevation has a circumferential pot wall 13 and a pot ceiling 14, which connects to the pot wall 13 along its upper edge and extends transverse to the central axis x. An inlet opening 15 preferably can extend centrally through the pot ceiling 14.

A receptacle wall 16 encompassing the pot wall 13 extends concentric to the pot wall 13 and at a radial distance therefrom. The circumferential end face of this receptacle wall, which is directed vertically upward, extends at least approximately in the plane defined by the upwardly directed surface of the pot ceiling 14.

The thusly formed insert part 10 may be fixed on the compound container 3, particularly in the region of the opening edge of the compound container 3, by means of a snap-in connection.

In addition, the insert part 10 may be designed for attaching the closing cap 8 by means of a snap-in connection, wherein the insert part 10 may have a circumferential vertical collar 17, which protrudes beyond the opening plane E of the compound container 3 and in the attached position of the cap can interact with a lower circumferential edge region of the closing cap 8.

Furthermore, the vertical collar 17 may also serve for guiding the head piece 4 in the vertical direction. To this end, the vertical collar 17 may interact with the outer side of an annular wall section 18 of the head piece 4, which according to the illustrations is aligned vertically.

As a result of the above-described guidance, the head piece 4 can be vertically displaced relative to the storage volume 2 along the central axis x and at the same time guided accordingly, wherein the vertical downward displacement, as well as the vertical upward displacement, respectively is limited by means of a stop.

A discharge chamber 19 for the portioned discharge of the compound M is provided between the storage volume 2 and the head piece 4. In the starting position according to FIGS. 1 to 4, in particular, this discharge chamber essentially extends above the plug receptacle 12 of the insert part 10.

The discharge chamber 19 is at least over a partial vertical section delimited circumferentially to the central axis x by a radially inner sidewall 20 of the head piece 4, wherein said discharge chamber is on the ceiling side likewise delimited by a ceiling section 21, which analogous to the sidewall 20 is also realized integrally and uniformly in material with the head piece 4.

Another circumferential delimitation, which essentially connects to the sidewall 20 vertically downward, as well as a vertically lower delimitation of the discharge chamber 19, is formed by a spring element 22.

The head piece 4 furthermore has a discharge channel 23 with a discharge opening 24. The discharge channel 23 can be connected to the discharge chamber 19 via an outlet opening 25 formed in the sidewall 20. The compound M, which is intermediately stored in the discharge chamber 19 in a portioned manner, is discharged through the outlet opening 25 and the discharge channel 23 in the course of a pumping movement, during which the head piece is moved in the direction of the storage volume 2 along the central axis x and the volume of the discharge chamber 19 is at the same time reduced.

The above-described spring element 22 preferably is an injection moulded part that consists of a thermoplastic elastomer, optionally of silicone, whereas the other components of the dispenser 1 preferably consist of polypropylene and/or polyethylene. The dispenser 1 preferably can be recycled in its entirety as a result of this design.

With respect to an unloaded position, which preferably can correspond to the starting position according to FIGS. 1 to 4, the spring element 22 initially has a plate-like shape with a plate bottom that in the starting position forms a leg 26, which in a vertical section essentially extends horizontally as shown. In the region of its radially outer end, this horizontally aligned leg 26 preferably transforms integrally and uniformly in material into a curvature 27, which with respect to the graphic illustrations is directed vertically upward and furthermore transforms into an at least approximately vertical upward leg 28. The upward leg 28 accordingly forms the additional delimiting wall 29 for the discharge chamber 19 circumferentially to the central axis x.

The upward leg 28 transforms into a retaining projection 30 in the vertically upper region facing away from the curvature 27. This retaining projection may be realized in the form of a section that annularly extends about the axis x, wherein said section has in a vertical section according to the illustrations an essentially rectangular or square design and is accommodated in a retaining receptacle 31 of the head piece.

The retaining receptacle 31 may be realized in the form of a circumferential groove 32 that is open vertically downward as shown, wherein said groove has a groove ceiling 33 formed by the U-crosspiece and two sidewalls, which form the respective U-legs and in a vertical section preferably extend parallel to one another, and wherein a radially inner sidewall of the groove 32 may be formed by the above-described sidewall 20. A radially outer sidewall likewise extends circumferentially to the central axis x at a radial distance from the sidewall 20.

The retaining projection 30 preferably can be captured in the groove 32 or the retaining receptacle 31 in a form-fitting and/or frictionally engaged manner. In this case, the projection base 35, which according to the preceding description is designed with a rectangular cross section, may abut on the inner sidewall 20 on the radially inner side and on the sidewall 34 on the radially outer side, as well as optionally on the groove ceiling 33 with an end face that is directed vertically upward.

A projection leg 36, which protrudes vertically downward, furthermore may be formed on the projection base 35 integrally and uniformly in material, wherein said projection leg can likewise be supported on the facing surface of the radially outer sidewall 34.

In this case, the radially outer sidewall 34 may extend vertically downward so far that it protrudes beyond the projection leg 36. Furthermore, the vertical length a of the radially outer sidewall 34 starting from the groove ceiling 33 may correspond to approximately 1.5-times to 2.5-times, furthermore to approximately 2-times, the vertical length b of the radially inner sidewall 20.

The section of the spring element 22, which in the starting position has an essentially plate-like shape, is connected to the retaining projection 30 by means of a hinge-like taper 37 formed between the upward leg 28 and the retaining projection 30. This hinge-like taper 37 is realized in the form of a material diminution in comparison with both adjoining regions. For example, the material thickness in the region of the taper 37 essentially may correspond to approximately 0.3-times to 0.7-times, e.g. to 0.5-times, the thickness d in the region of the upward leg 28 and/or the curvature 27 and/or the leg 26.

With respect to the arrangement on the retaining projection 30, the taper 37 may be positioned in such a way that the projection base 35 extends vertically upward and the projection leg 36 extends vertically downward starting from this taper 37, wherein the projection leg 36 furthermore may extend radially outside of the upward leg 28 and at a radial distance therefrom.

In addition, the radially inner sidewall 20 of the head piece 4 may have such a vertical length b that it ends in the region of the taper 37 or above this taper 37.

An annular plug projection 38 protrudes vertically downward from the leg 26, which in a vertical section extends horizontally and essentially forms the plate bottom of the spring element 22. This plug projection engages into the groove-like plug receptacle 12 and accordingly between the pot wall 13 and the receptacle wall 16 in a retaining manner.

Figure 3:
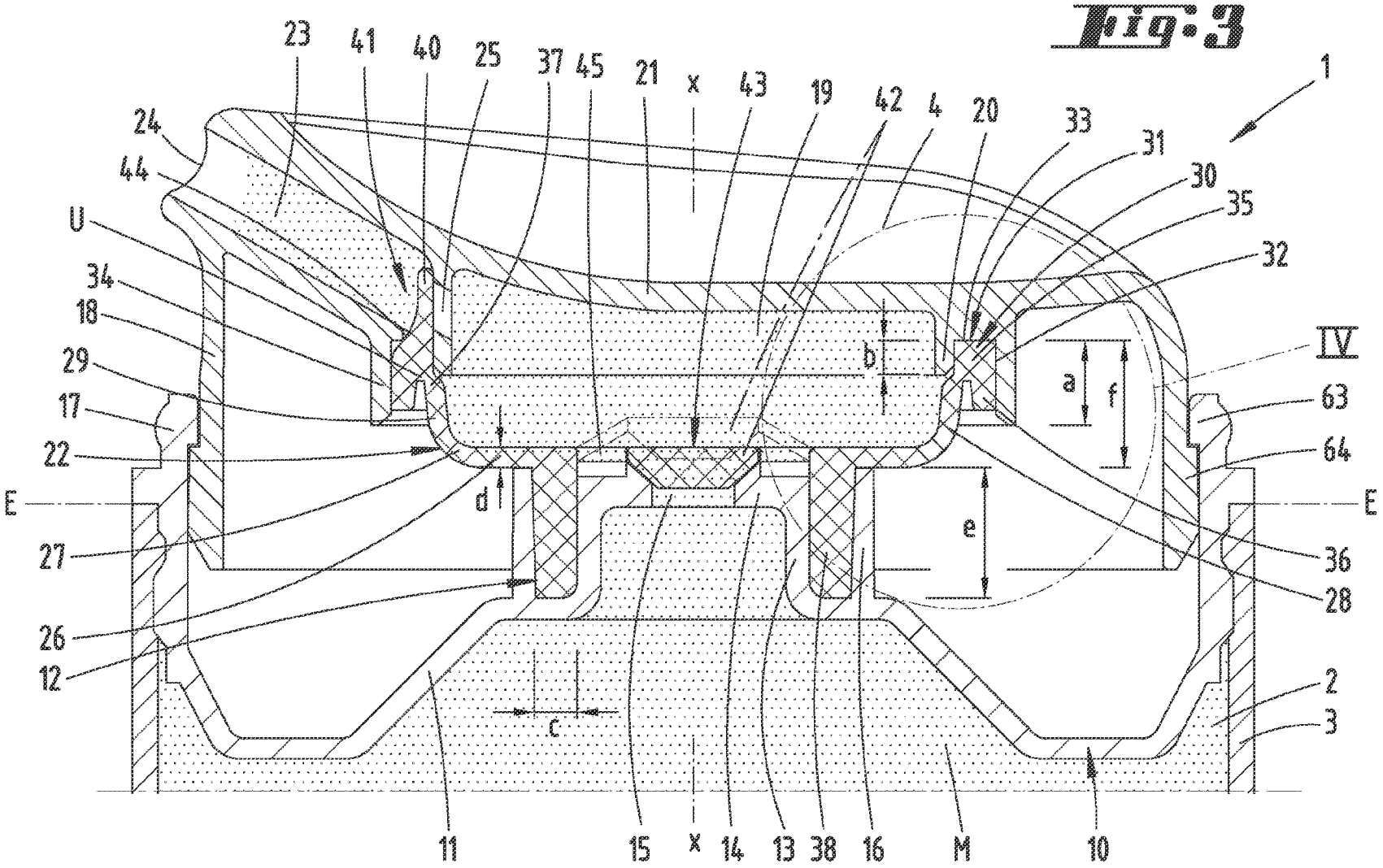
FIG. 3 shows an enlarged detail of the region III in FIG. 1 after the removal of a covering cap.
Figure 4:
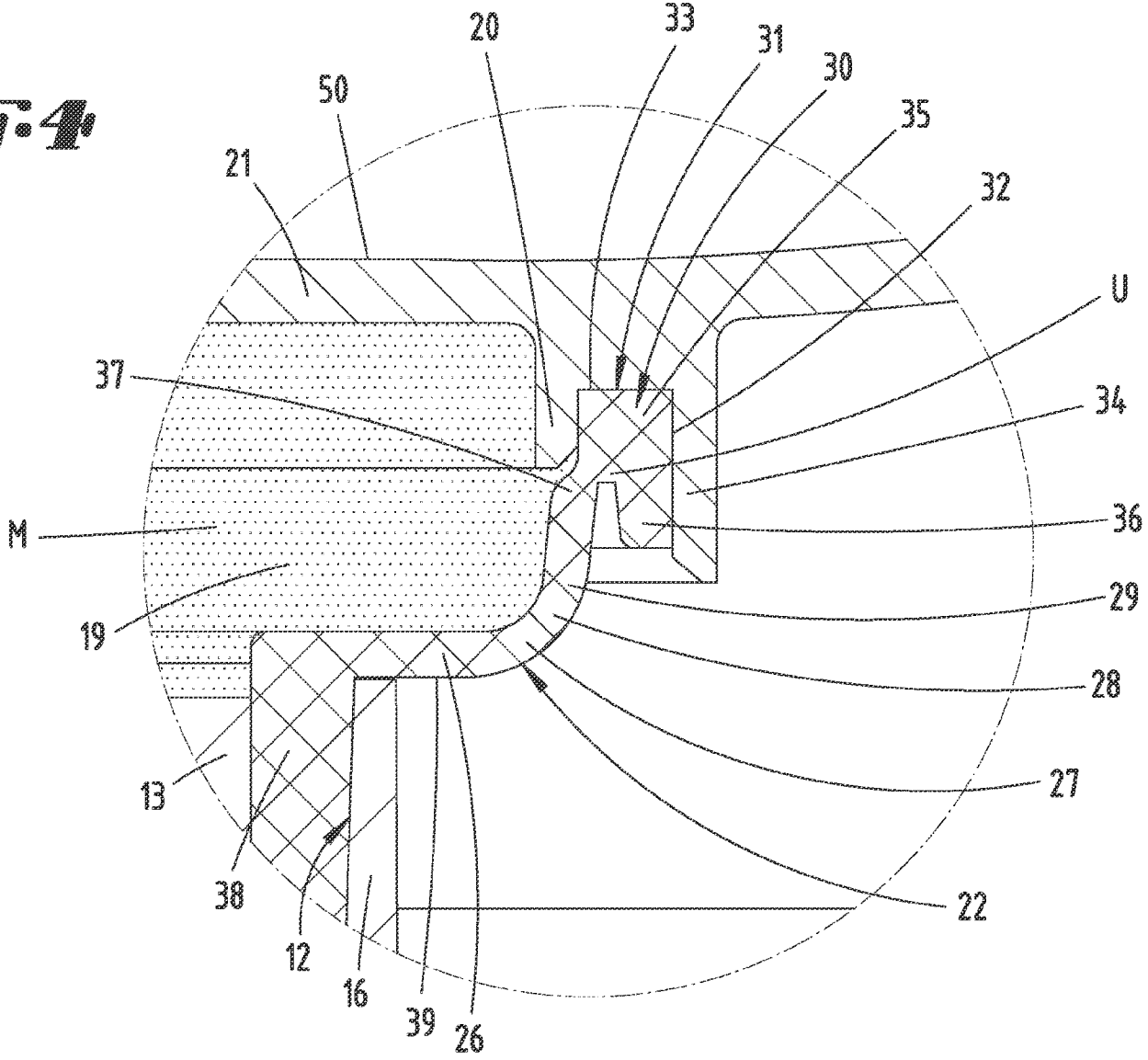
FIG. 4 shows an enlarged detail of the region IV in FIG. 3.

With respect to a vertical section, e.g., according to FIG. 3, the plug projection 38 may have a radially measured wall thickness c that corresponds to 1.5-times to 2.5-times, furthermore to approximately 2-times, the greatest thickness d in the region of the horizontally extending leg 26 and/or the curvature 27 and/or the upward leg 28.

In addition, the plug projection 38 may have an axial length e starting from a lower edge 39 of the leg 26 extending horizontally in the starting position, wherein said length e may according to the exemplary embodiment shown approximately correspond to the length f of the spring element 22 between the lower edge 39 and the axially upper end of the retaining projection 30.

The retaining projection 30, as well as the plug projection 38, preferably can be realized integrally and uniformly in material with the plate-like spring element section. In addition, a valve section 40 for forming an outlet valve 41, as well as a valve plug for forming an inlet valve 43, furthermore may be provided integrally and uniformly in material.

The valve section 40 may be integrally formed on the retaining projection 30 in the region of its axially upper end in a tab-like manner. This valve section 40 penetrates into the discharge channel 23 through a provided opening 44 and places itself in front of the outlet opening 25 in a sealing manner in the closed valve position (compare particularly to FIG. 3).

The valve plug 42 is connected to the region of the leg 26 extending horizontally in the starting position by means of webs 45 and closes the inlet opening 15 in a valve-like manner in the starting position according to FIG. 3.

According to a potential embodiment, an installation of the head piece 4 and the spring element 22 may be realized in that the spring element 22 is initially attached to the insert part 10 as a result of inserting the plug projection 38 into the plug receptacle 12 and the head piece 4 is subsequently attached by inserting the retaining projection 30 into the retaining receptacle 31 and the valve section 40 into the discharge channel 23 through the opening 44. Alternatively, the spring element 22 may initially be retained on the head piece 4 by correspondingly inserting the retaining projection 30 into the retaining receptacle 31, whereupon the head piece 4 provided with the spring element 22 is attached to the compound container 3 by inserting the plug projection 38 into the plug receptacle 12 of the insert part 10.

In both instances, the self-localization is advantageously promoted in the course of the assembly. In its unloaded starting position, the spring element 22 has an advantageous rigidity for its installation.

In the starting position according to FIG. 3, the spring element 22 furthermore may be in a relaxed position or in a position that nearly corresponds to a relaxed position. This results in long-lasting sound spring characteristics of the spring element 22 and furthermore in advantageous haptics for the user when the head piece 4 is lowered in the course of a dispenser actuation.

Figure 5:
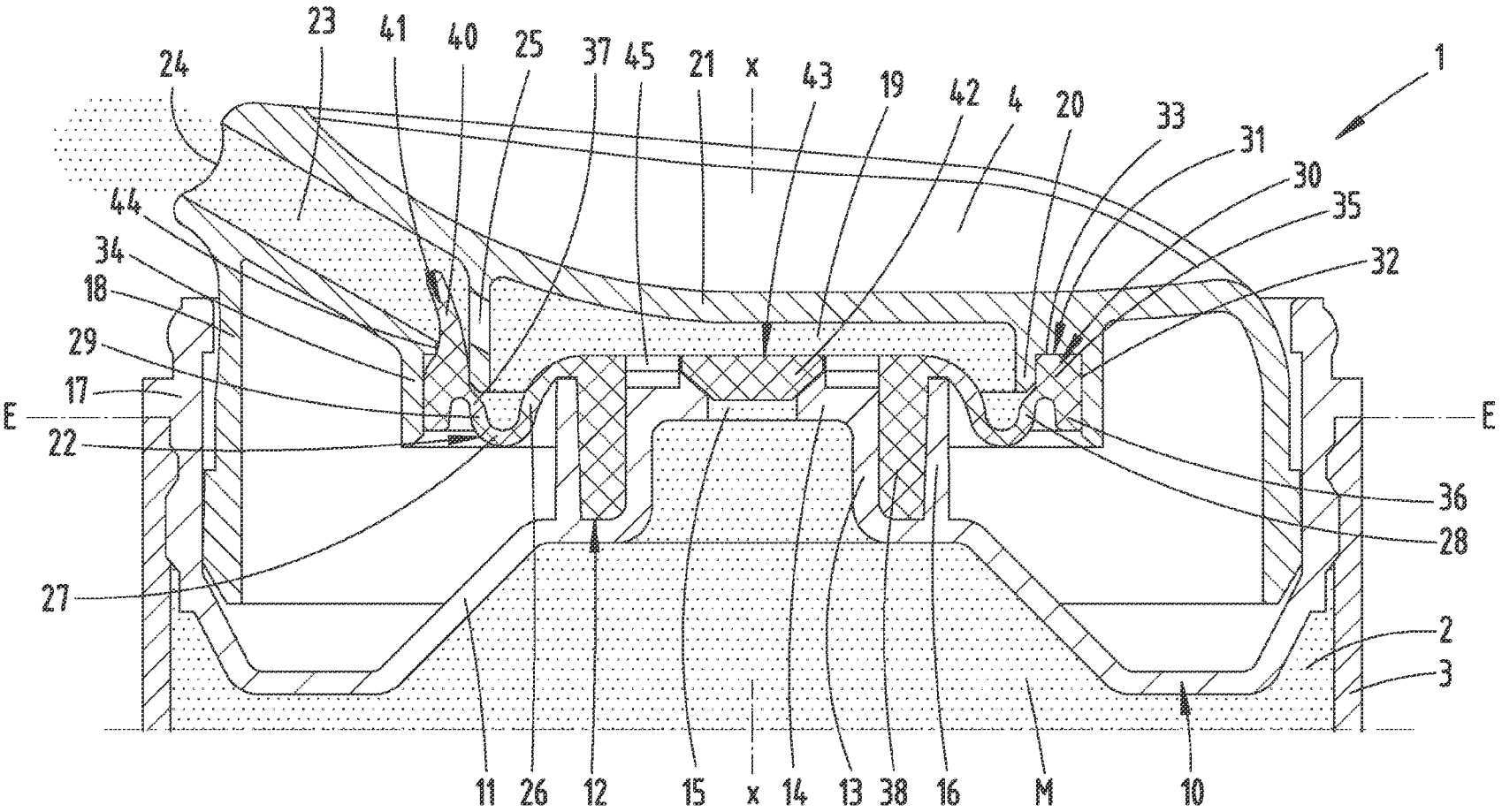
FIG. 5 shows an illustration that corresponds to FIG. 3, however, after the displacement of a head piece from the starting position according to FIG. 3 into an actuation position.
Figure 6A:
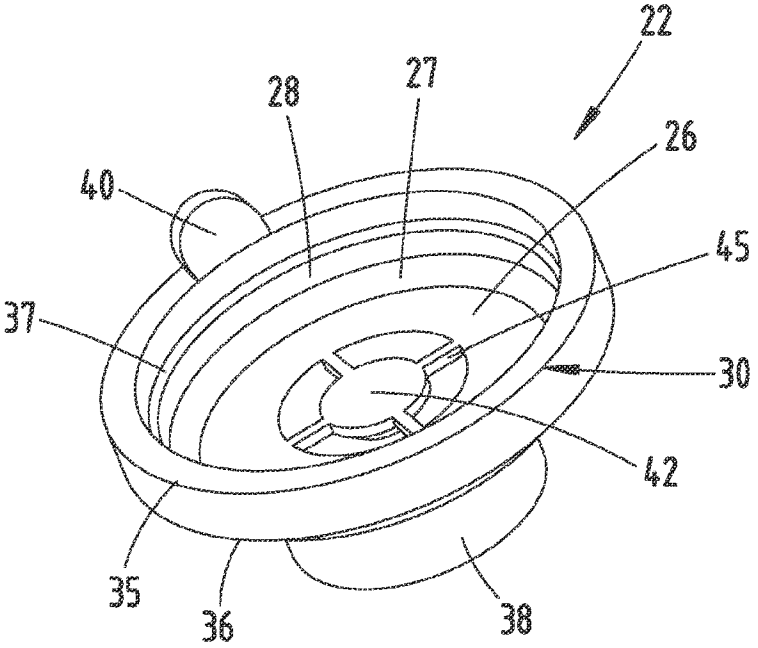
FIG. 6 shows an individual perspective view of a spring element arranged between the storage volume and the head piece.
Figure 6B:
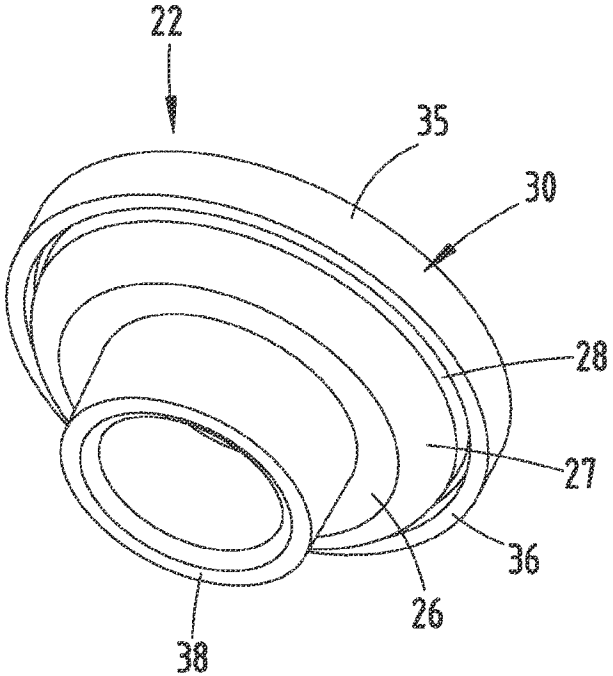

A lowering movement of the head piece 4 along the central axis x in the direction of the compound container 3 results in a compound discharge (compare to FIG. 5). A pressure increase is achieved in the course of this lowering movement, during which the volume of the discharge chamber 19 is reduced. The valve section forming the outlet valve 41 is lifted as a result of this pressure increase in order to release the outlet opening 25. The compound M stored in the discharge chamber 19 is (at least partially) discharged via the discharge channel 23.

The valve plug 42 forming the inlet valve 43 is pressed into the region of the inlet opening 15 in a sealing manner in the course of this lowering movement as a result of the associated pressure load.

A spring restoring force is built up in the spring element 22 in the course of this lowering movement of the head piece 4. According to FIG. 5, this may take place as a result of a downward pivoting movement of the leg 26, which in the starting position essentially extends horizontally, about a temporary bending axis resulting in the region of the support of the leg 26 on the free end face of the receptacle wall 16 such that an essentially U-shaped region, which particularly in the actuation position according to FIG. 5 essentially extends underneath the supporting plane of the receptacle wall 16 for the leg 26, is in a vertical section formed with the leg 26, the curvature 27 and the upward leg 28 in the lowered head piece position and therefore in the tensioned position of the spring element 22.

An automatic return from this actuation position according to FIG. 5 takes place once the pressure exerted upon the head piece 4 ceases, particularly as a result of the return of the leg in the direction of its normal horizontal alignment. The associated negative pressure in the discharge chamber 19 promotes the sealing effect of the valve section 40 relative to the outlet opening 25 and causes the valve plug 42 to lift off the inlet opening 15 (see dot-dashed illustration in FIG. 3) such that compound M is drawn into the discharge chamber 19 through the inlet opening 15 when the head piece 4 is displaced back in the direction of the starting position.

Figure 8:
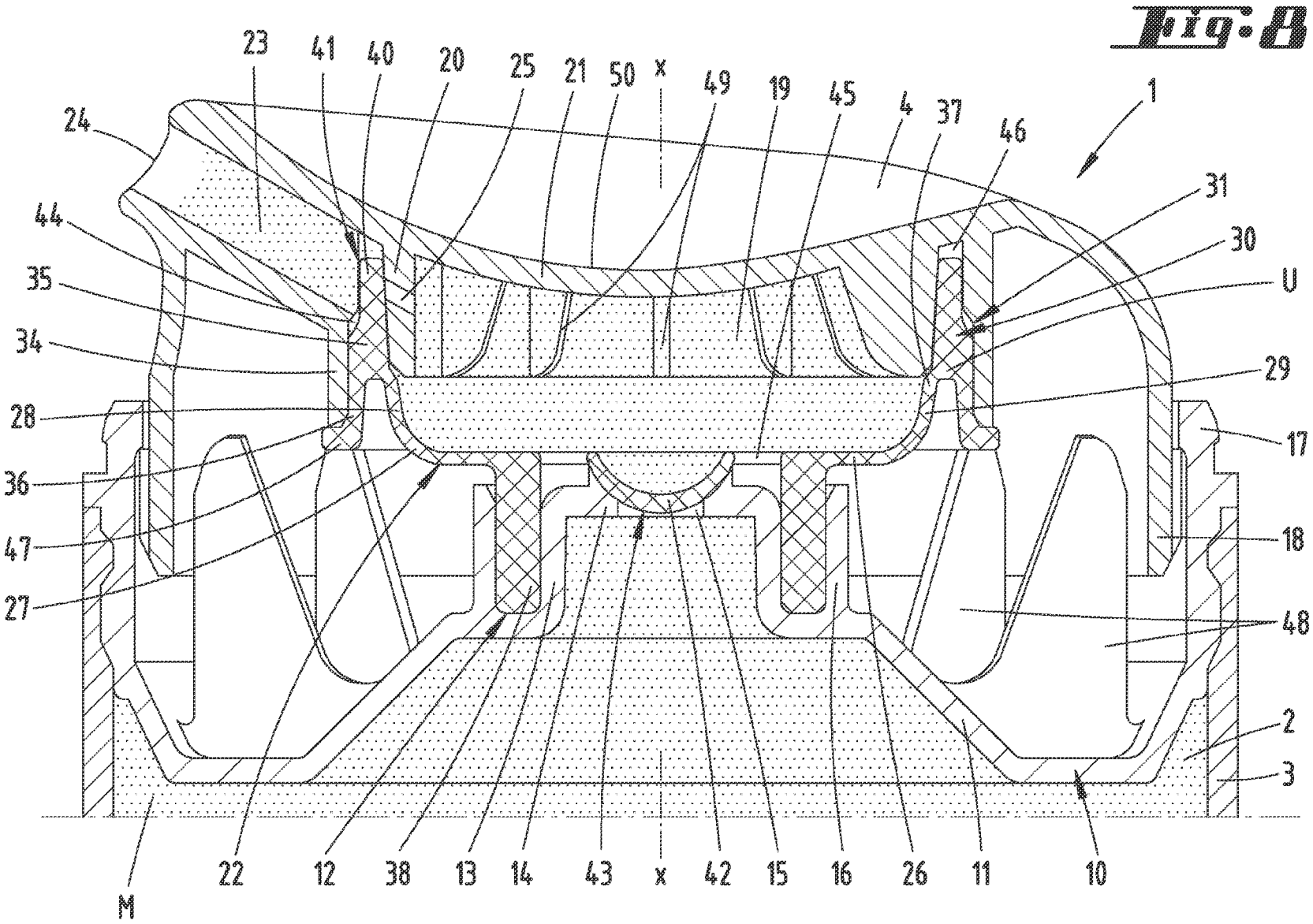
FIG. 8 shows a sectional view that essentially corresponds to FIG. 3, but concerns a second embodiment.
Figure 9:
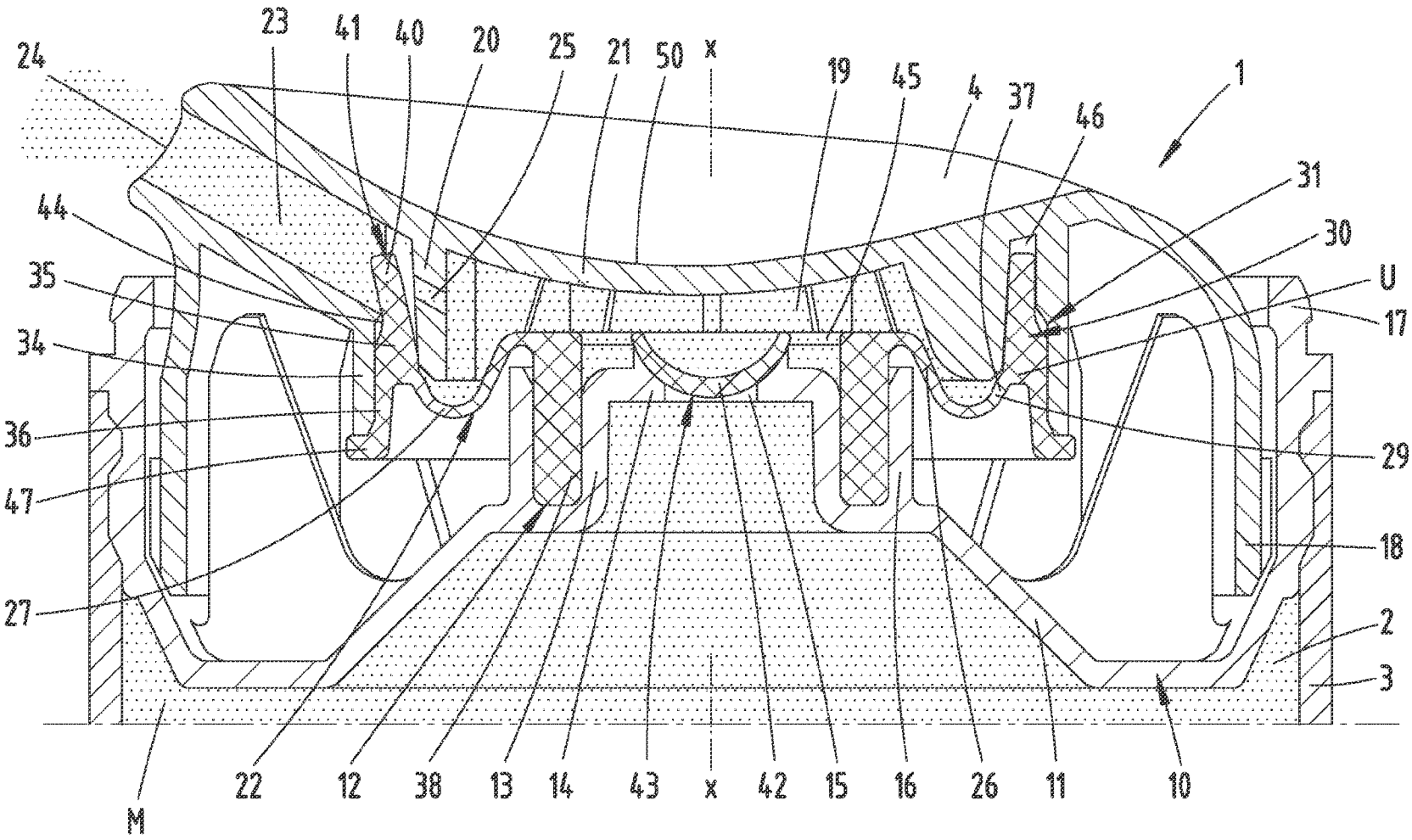
FIG. 9 shows the embodiment according to FIG. 8 after the displacement of the head piece into an actuation position.

If the tab-like valve section 40 in the first exemplary embodiment illustrated in FIGS. 1 to 7 extends exclusively within the discharge channel 23 and accordingly with a circumferential length that preferably is smaller than the inside diameter of the discharge channel 23, a vertical section 40, which essentially lips out vertically upward, is according to the second exemplary embodiment illustrated in FIGS. 8 and 9 also formed in this case, wherein this vertical section is designed such that it extends circumferentially to the central longitudinal axis x in a uniform and closed annular manner above the retaining projection 30.

In order to completely accommodate the thusly designed spring element 22 and to fit the head piece 4 with this spring element in a preferably non-oriented manner, the head piece 3 is viewed in the circumferential direction provided with a circumferential groove 46 for accommodating the valve section 40 outside the discharge channel 23. The valve section 40 can completely protrude into this groove 46 with respect to a described cross section. Furthermore, the groove 46 may be designed with such a radial dimension that a displacement of the valve section 40 accordingly can be prevented outside the discharge channel 23 in the course of a compound discharge.

Furthermore, the groove 46 preferably can be designed in the form of a vertical extension of the retaining receptacle 31 with optionally reduced cross section.

According to the above-described embodiment, the channel wall that circumferentially delimits the discharge channel 23 is viewed in the circumferential direction provided with a slot-like opening to both sides of the discharge channel 23, wherein said openings preferably are completely sealed by the valve section 40 extending through these openings.

It is preferred that an aforementioned tab-like pivoting movement of the valve section 40 only takes place in the region within the discharge channel 23, in which it covers the outlet opening 25 in a valve-like manner, in the course of a downward movement of the head piece 4 for a compound discharge and the associated pressure increase within the discharge chamber 19 (compare to FIG. 9).

According to the exemplary embodiment illustrated in FIGS. 8 and 9, the projection leg 36 of the retaining projection may protrude vertically downward beyond the radially outer sidewall 34 and engage underneath the radially outer sidewall 34 such that an additional advantageous retention of the spring element 22 on the head piece 4 can be achieved. In addition, the head piece 4 can be axially supported on the base section 47 connecting to the projection leg 36 by means of the radially outer sidewall 34.

Analogous to the third exemplary embodiment described further below, the insert part 20 furthermore may have ribs 48 that are directed toward the head piece 4 and integrally formed on the insert part circumferentially to the receptacle wall 16, particularly for stabilizing the insert part 10. The illustrations furthermore show that these ribs 48 may be uniformly distributed over the circumference.

The head piece 4 may also have such ribs 49, wherein these ribs may be formed on the underside of an actuating surface 50 of the ceiling section 21 such that they are directed into the interior of the discharge chamber 19. These ribs 49 preferably can also be realized integrally and uniformly in material with the head piece 4, wherein a plurality of such ribs 49 preferably is uniformly distributed about the central longitudinal axis x.

In addition, the circumferential valve section 40 of the embodiment in FIGS. 8 and 9 may in the normal usage position, particularly in the closed valve position according to FIG. 8, lie in the groove 46 or in the seal seat within the discharge channel 23 such that it is elastically deformed radially outward from an essentially vertical alignment in the unaffected preassembly state by a few angular degrees, e.g. by 1° to 3°. This results in a corresponding prestress of the valve section 40 in the direction of the sealing position.

Figure 10:
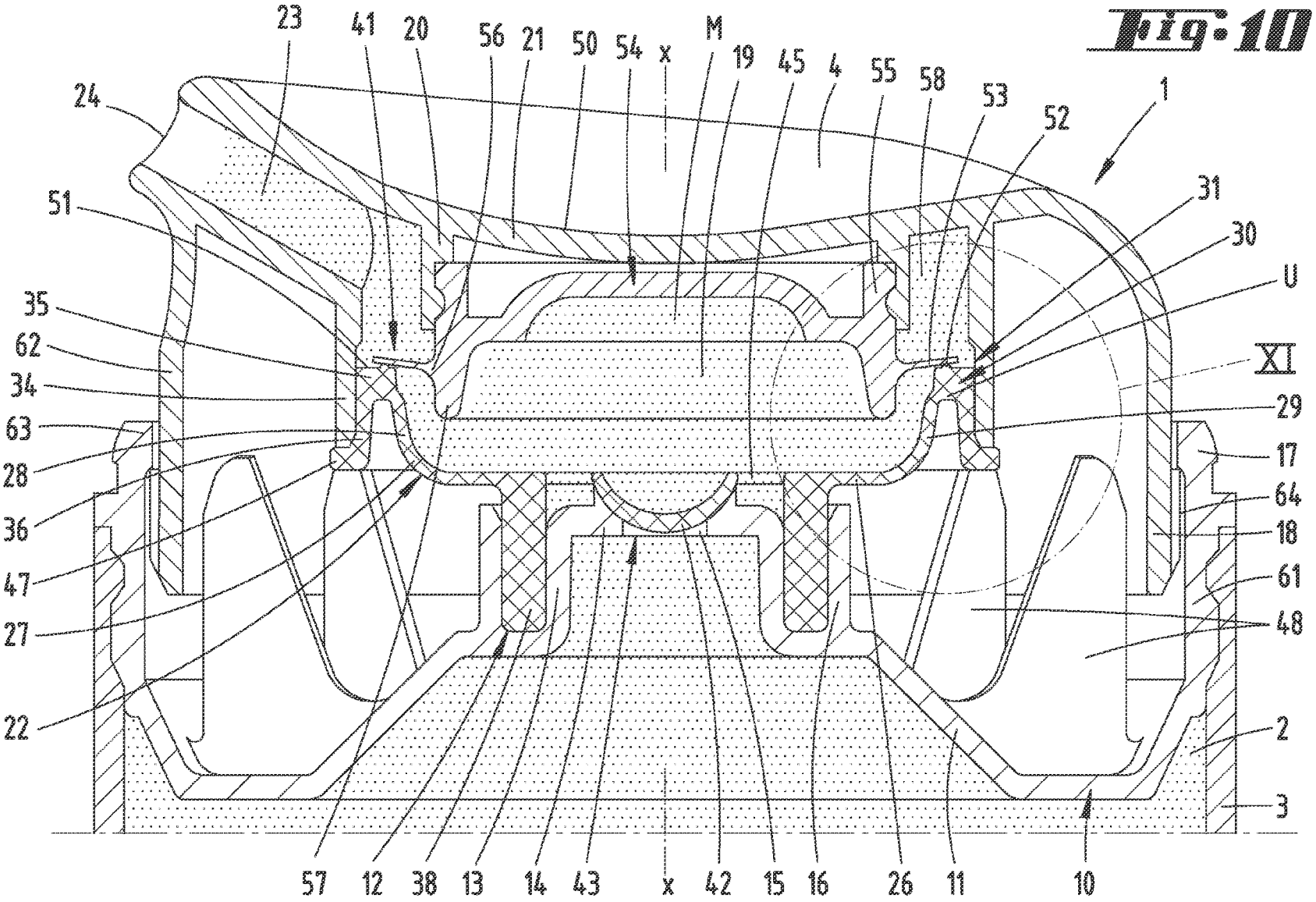
FIG. 10 shows another sectional view that corresponds to FIG. 3, but concerns a third embodiment.
Figure 11:
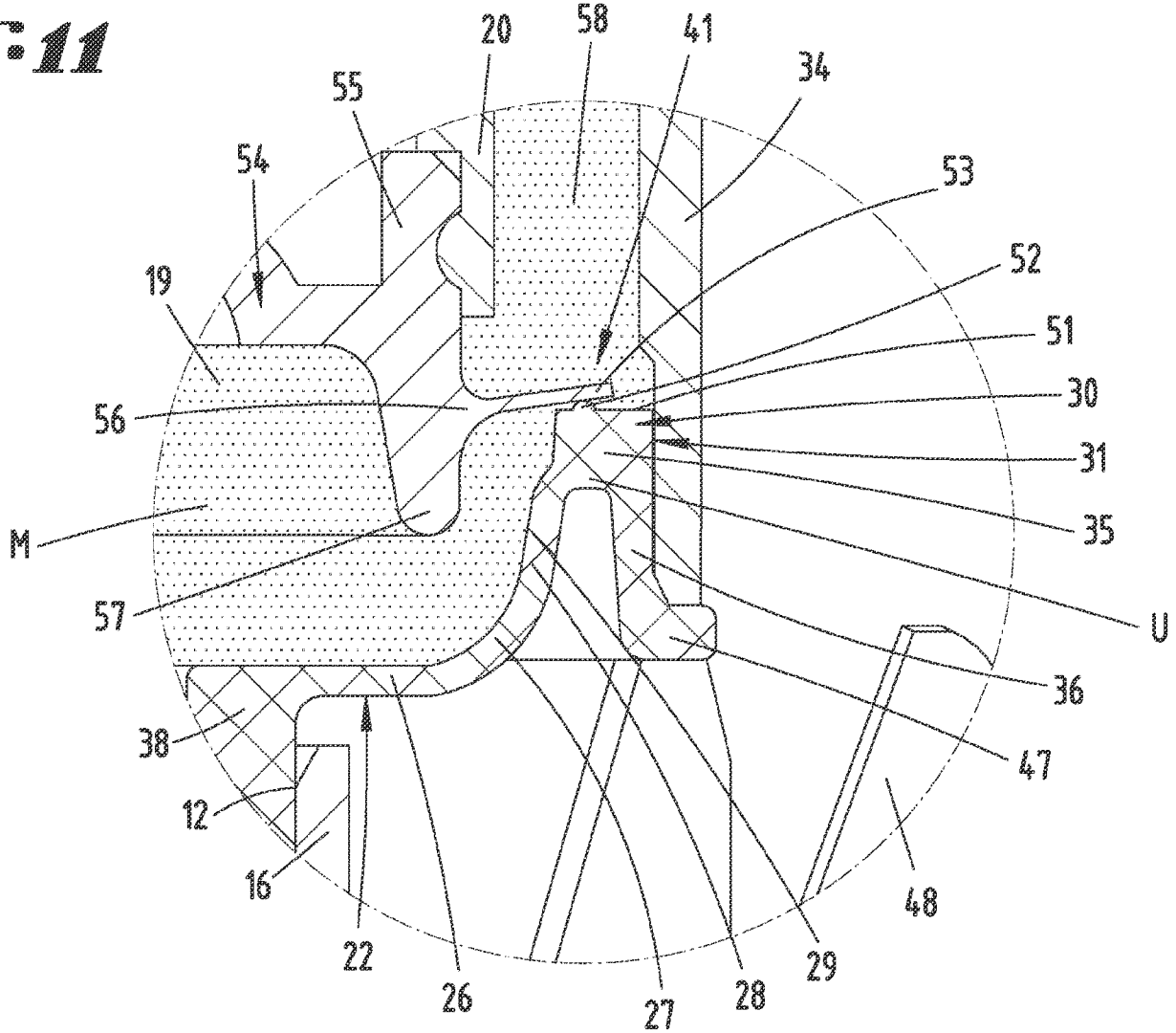
FIG. 11 shows an enlarged detail of the region XI in FIG. 10.
Figure 12:
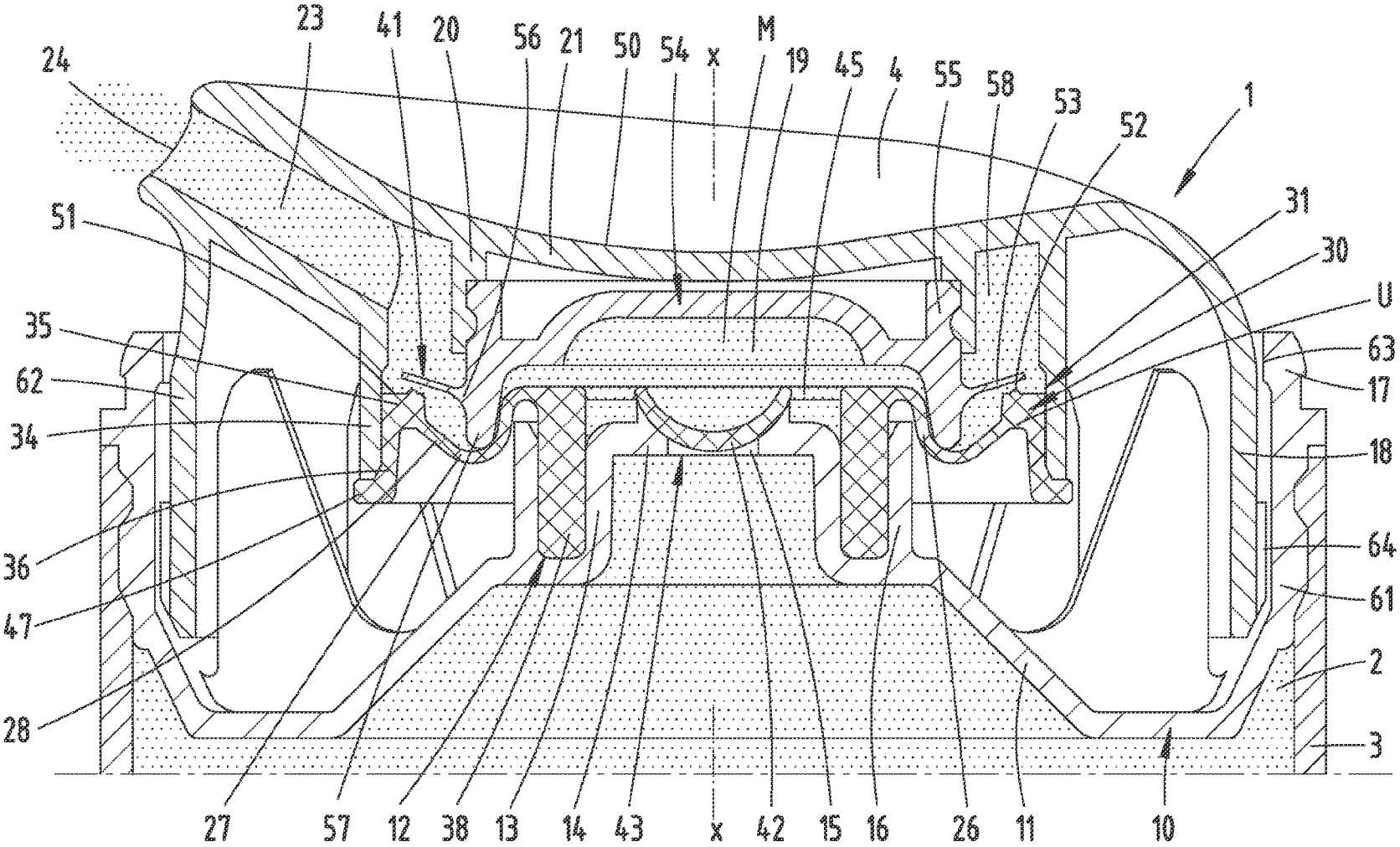
FIG. 12 shows the embodiment according to FIG. 10 in the actuation position.
Figure 13:
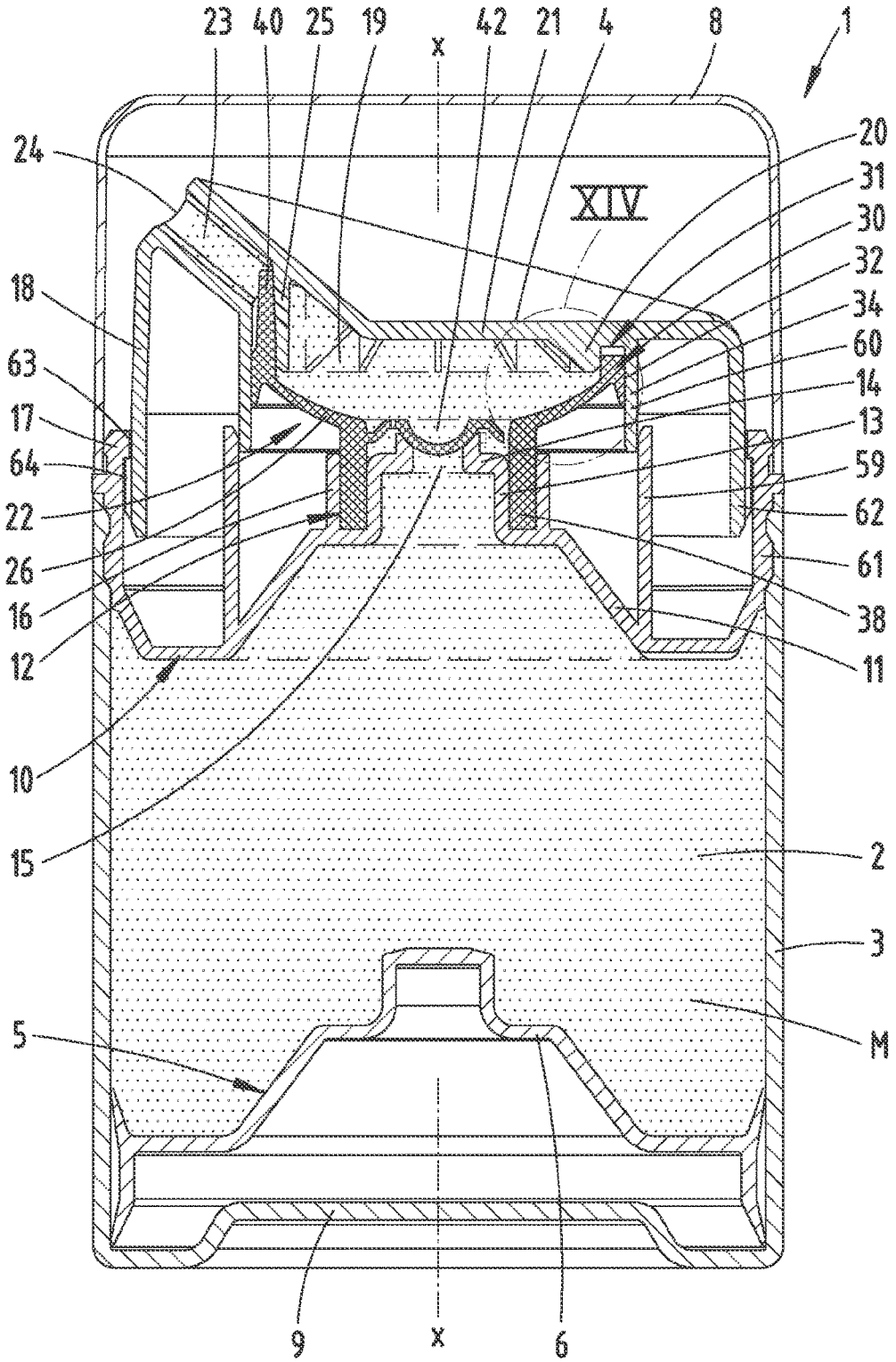
FIG. 13 shows an illustration according to FIG. 1, but concerning a fourth embodiment in the starting position.
Figure 14:
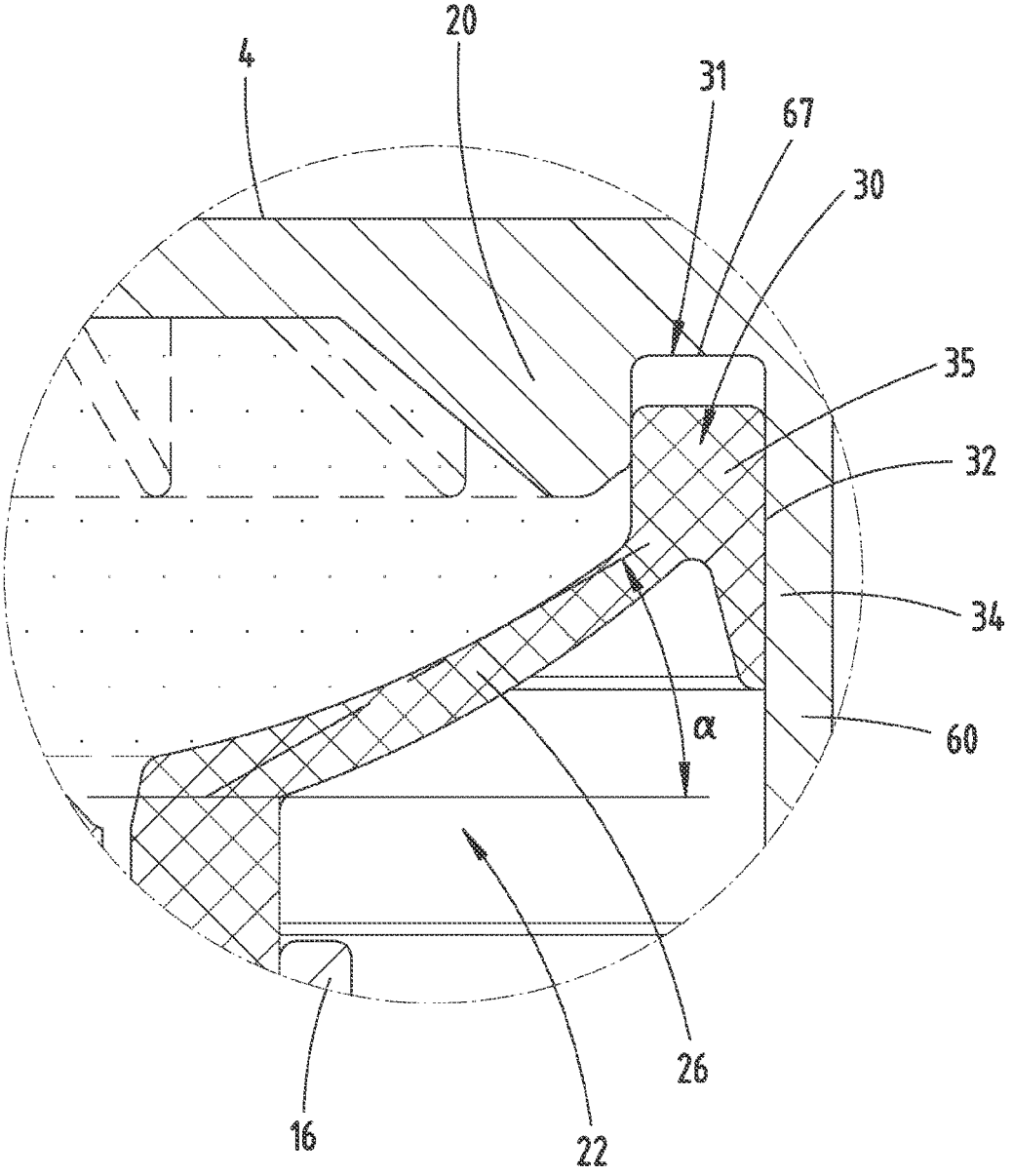
FIG. 14 shows an enlarged detail of the region XIV in FIG. 13.
Figure 15:
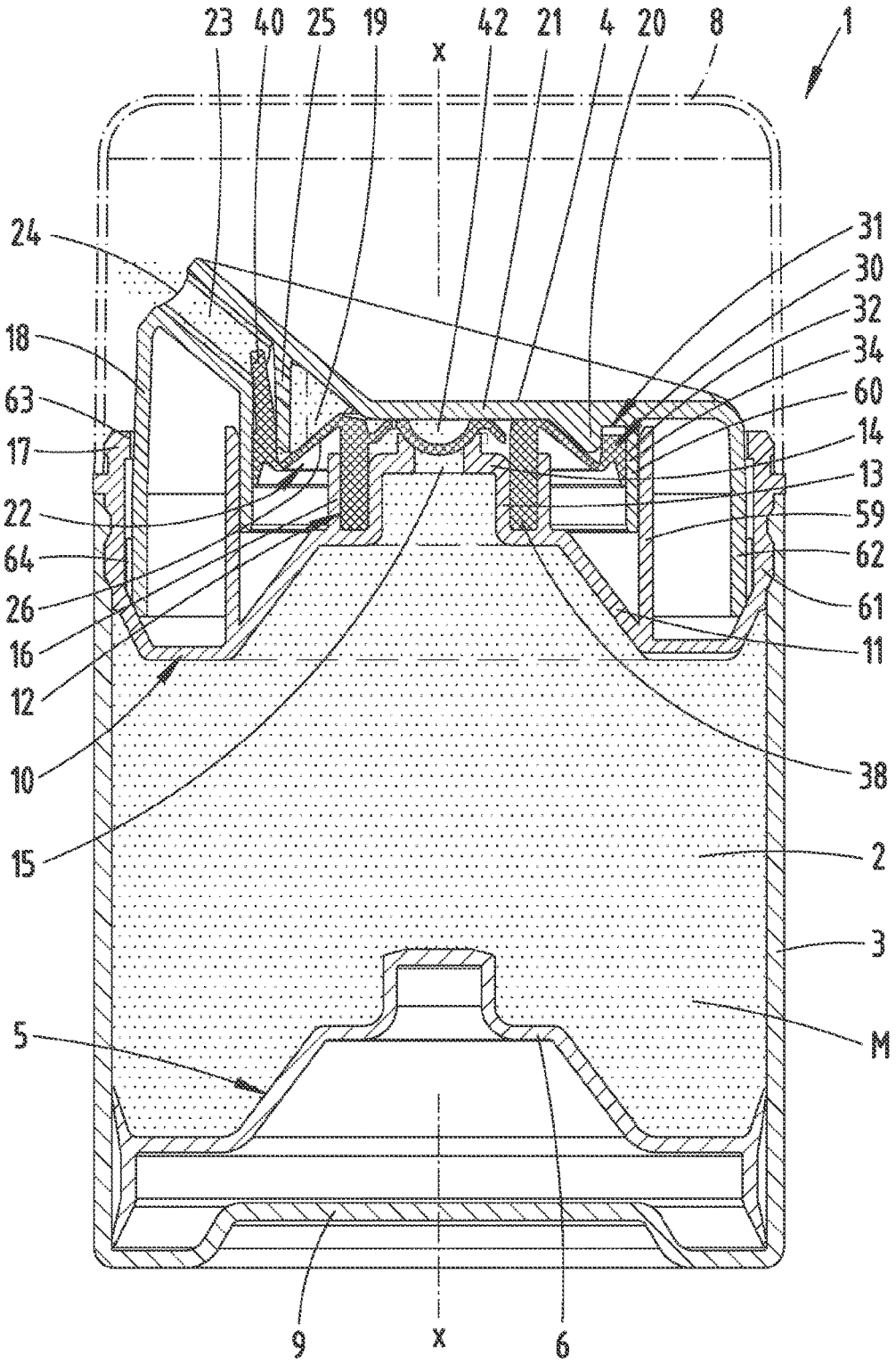
FIG. 15 shows the embodiment according to FIG. 13 in the actuation position.
Figure 16:
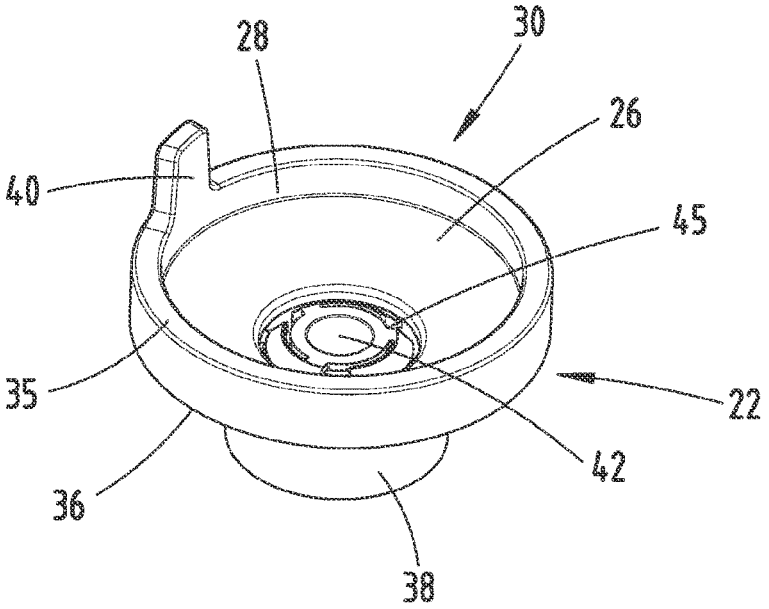
FIG. 16 shows an individual perspective view of the spring element of the fourth embodiment.
Figure 17:
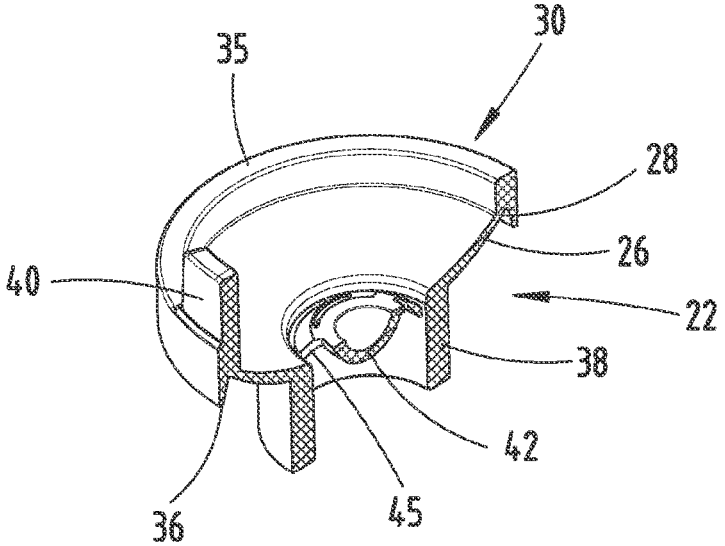
FIG. 17 shows a perspective sectional view of the spring element of the fourth embodiment.
Figure 18:
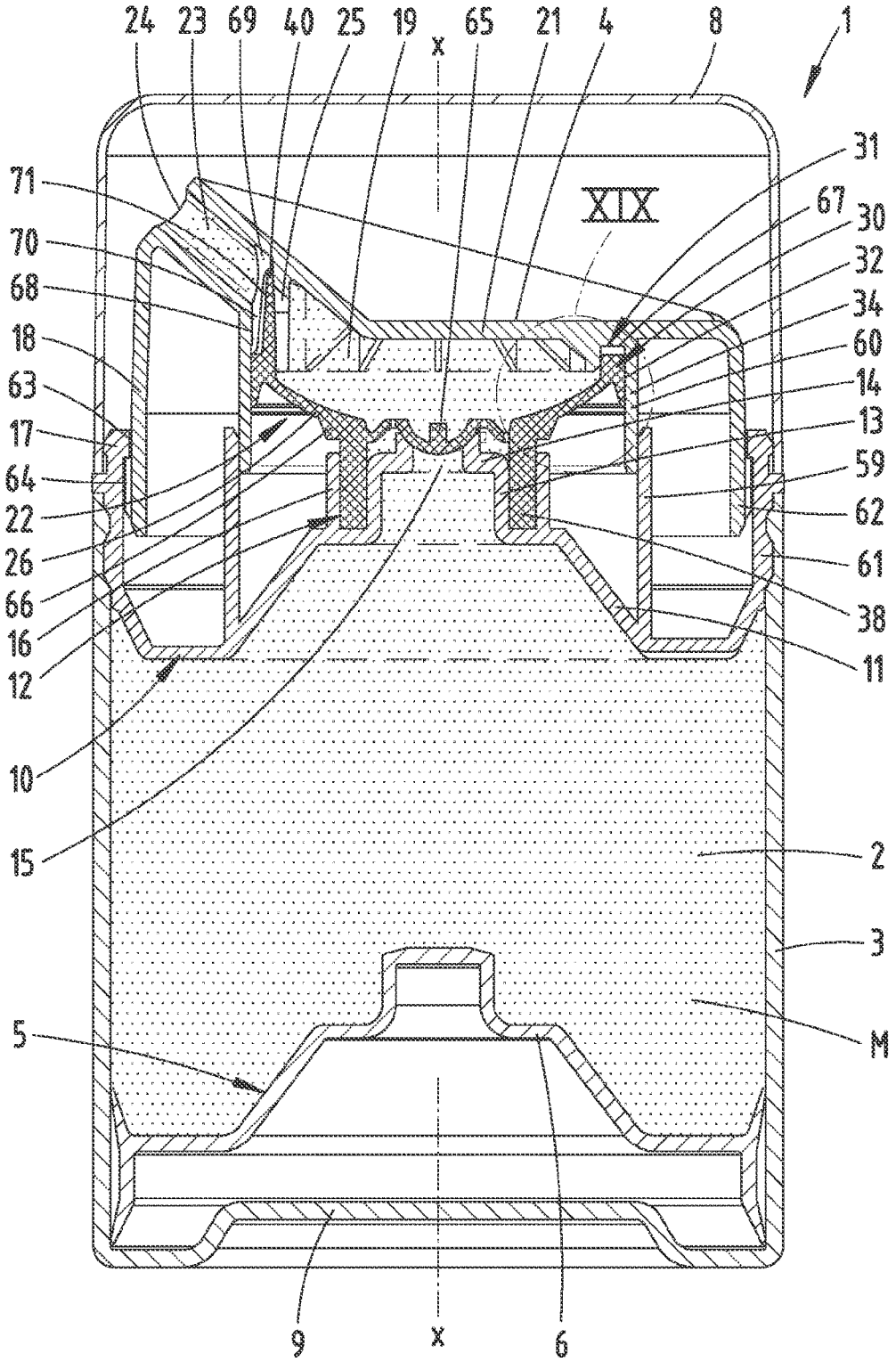
FIG. 18 shows another illustration that corresponds to FIG. 1, but concerns a fifth embodiment in the starting position.
Figure 19:
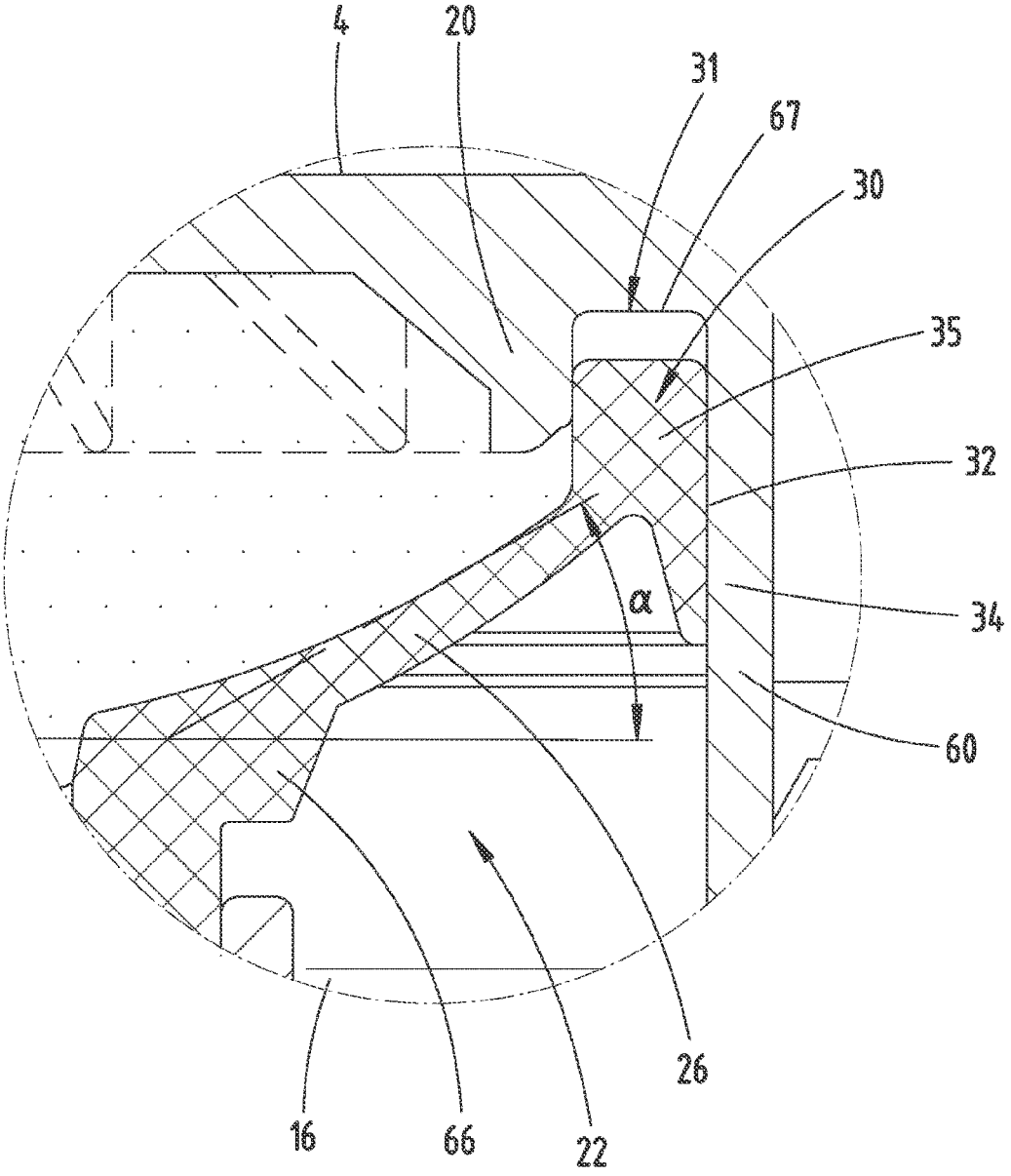
FIG. 19 shows an enlarged detail of the region XIX in FIG. 18.

FIGS. 10 to 12 show another embodiment, in which the retaining projection 30 of the spring element 22 is retained on the head piece 4, in particular, due to a radially outer abutment on the sidewall 34 of the storage volume 2. The retaining receptacle 31 essentially is formed by the sidewall 34 in this case. In the usage position according to FIGS. 10 to 12, the retaining projection 30 lies in the retaining receptacle 31 in a form-fitting and frictionally engaged manner and at the same time abuts on the facing surface of the sidewall 34, wherein a lower base section 47 of a projection leg 36, which is likewise provided in this case, furthermore can engage underneath the sidewall 34 in this embodiment.

The retaining projection 30 may have a supporting surface that is exposed vertically upward. According to the illustrations, this supporting surface essentially may be aligned in a plane extending transverse to the central longitudinal axis x.

An annular projection 52 with bead-like cross section, which altogether extends concentric to the central longitudinal axis, may be formed on the supporting surface 51, particularly as a result of being designed integrally and uniformly in material with the retaining projection 30, especially with the spring element 22.

The annular projection preferably serves for forming the outlet valve 41 in interaction with a lip section 53 of the head piece 4.

In this case, the lip section 53 essentially is realized in the form of a flat part, which particularly in the unloaded preassembly position essentially extends horizontally. The lip section 53 preferably can be formed integrally and uniformly in material on a plug part 54 that is arranged on the head piece 4. The plug part 54 can on the radially inner side interact with the radially inner sidewall 20 so as to form a snap-in connection.

The lip section 53 furthermore may extend at a vertical distance from the vertically lower end of the sidewall 20 and freely protrude radially outward on a circumferential plug part wall 55, which interacts with the radially inner sidewall 20, starting from a radially inner retaining region 56. In the region of the radially outer free end region, the surface of the lip section 53, which is directed vertically downward, interacts with the projection 52 in a sealing manner. In a closed valve position according to FIG. 10, the lip section 53 may in a cross section include an acute angle of a few angular degrees, e.g. 2° or 3°, with a horizontal plane under prestress.

The plug part wall 55 may protrude vertically downward beyond the region of the circumferential lip section 53 and form a ring section 57. This ring section 57 is suitable for penetrating into and essentially filling out the essentially U-shaped spring leg region being formed in the depressed dispenser actuation position according to FIG. 12.

During this dispenser actuation and the associated pressure increase in the discharge chamber 19, the lip section 53 is lifted off its seal seat (projection 52 of the retaining projection 30) as a result of a pivoting movement of the lip section 53 about the retaining region 56. In this open outlet valve position, the compound M is conveyed into an annular space 58 formed between the sidewalls 20 and 34 past the lip section 53 and into the discharge channel 23 via this annular space.

In this case, the plug part 54 essentially may form the ceiling of the discharge chamber 19.

According to the above-described embodiments, a guidance of the head piece 4 in the direction of the central longitudinal axis x can be achieved on the insert part 10 and therefore on the compound container 3 comprising the storage volume 2 due to a guiding abutment of the ribs 48 of the insert part on the facing inner surface of a fourth cylinder section 62 of the head piece 4, wherein said fourth cylinder section 62 may be directly formed by the annular wall section 18.

The vertical collar 17 may form part of a third outer cylinder section 61 of the insert part 10 and on its end facing the head piece 4 form an optionally annular stop projection 63 that is directed radially inward. This stop projection 63 preferably serves for stop-limiting the head piece 4 in the starting position in that the stop projection 63 interacts with a mating stop 64 of the head piece 4. This mating stop 64 preferably can be integrally formed on the aforementioned fourth cylinder section 62 of the head piece 4.

In the above-described embodiments, a guidance and a stop limitation accordingly are achieved with the same component of the head piece 4, in this case the fourth cylinder section 62.

In the fourth and fifth embodiments of the dispenser 1 illustrated in FIGS. 13 to 22, different components of the head piece 4 and the insert part 10 are used for respectively realizing the stop limitation and the guidance. The insert part preferably is not provided with any ribs 48 in these embodiments.

In addition to the radially outer third cylinder section 61, the insert part 10 in fact has another radially inner first cylinder section 59 that preferably is aligned concentric to the third cylinder section 61. The first cylinder section 59 of the insert part 10 preferably originates in a transition area between the conical region 11 of the insert part 10 and a bottom of the insert part 10, which essentially extends transverse to the central longitudinal axis x. This first cylinder section 59 may viewed in the axial direction approximately extend as far as into the opening plane of the insert part 10, which is defined by the free edge of the third cylinder section 61, starting from the bottom of the insert part 10.

The stop limitation is in these embodiments also realized as a result of the interaction between the third cylinder section 61 of the insert part 10 and the fourth cylinder section 62 of the head piece 4, particularly the stop-limited interaction between the stop projection 63 of the insert part and the mating stop 64 of the head piece, wherein the mating stop 64 optionally may be formed by individual ribs, which are arranged over the circumference on the outer wall of the fourth cylinder section 62 and essentially extend in the axial direction.

In contrast, the guidance is realized due to the interaction of the first cylinder section 49 of the insert part with a second cylinder section 60 of the head piece 4, which is provided separately in this case, wherein the first cylinder section 59 of the insert part may according to the illustrations be arranged radially outside of the second cylinder section 60 of the head piece 4. All in all, the guidance cylinder sections are provided radially inside of the stop cylinder sections, wherein the second cylinder section 60 of the head piece may according to a preferred embodiment be formed by the annular wall section 18 of the retaining receptacle 31, which in comparison with the previously described exemplary embodiments is extended in the axial direction.

The valve plug 42 of the fourth and the fifth embodiment may be realized in a cup-like manner as described above, e.g., with reference to FIG. 12. According to the illustrations in FIGS. 18 to 22, such a cup-like valve plug 42 may have a pin 65 or optionally a web or crossweb, which preferably can be realized integrally and uniformly in material with the valve plug 42, in its center accommodating the central longitudinal axis x. This pin 65 may extend from a cup base of the valve plug 42 as far as a cup opening plane of the valve plug 42. An increased rigidity can be achieved in this region of the valve plug 42 as a result of this design.

The fourth and the fifth embodiment furthermore can be distinguished from the embodiments 1 to 4 with respect to the design and the alignment of the leg 26 of the spring element 22. The fourth and the fifth embodiment preferably are not provided with a leg that essentially extends horizontally and transforms into an upward leg via a curvature. In the unloaded starting position, the leg 26 in fact extends in a conically ascending manner, preferably with a continuous curvature, wherein said leg starts directly in the transition into the plug projection 38 and runs into the retaining projection 30 on its end. With respect to a vertical section, e.g., according to FIG. 13 or FIG. 17, the leg 26 may extend along a straight line or preferably along a continuously curved line. According to the enlarged illustrations in FIGS. 14 and 19, a straight line connecting the run-in points of the leg 26 into the plug projection 38 on the one hand and into the retaining projection 30 on the other hand furthermore may include an acute angle $\alpha$ of approximately 15° to 30° with a plane that extends transverse to the central longitudinal axis x and preferably is aligned parallel to the opening plane E.

An advantageous installation of the spring element 22 can be achieved due to the conical design of its section that in a cross section is formed by the leg 26.

The conically ascending design of the leg 26 can provide greater stability of the spring element 22 in the non-actuated position, particularly with respect to an inadvertent depression of the head piece 4. In another embodiment, the conically ascending leg 26 furthermore may also be combined with a section according to the first exemplary embodiments, which essentially is aligned horizontally and originates from the plug projection 38.

According to the embodiment illustrated in FIGS. 18 to 22, a bead 66 furthermore may be formed integrally and uniformly in material on the underside of the leg 26 and therefore radially outside of the plug projection 38 in the transition area from the plug projection 38 into the leg 26. This bead 66 may have a lower surface that is directed at the insert part 10 and aligned transverse to the central longitudinal axis x as shown, wherein said lower surface may according to the illustrations furthermore assume an axial distance from the facing end face of the receptacle wall 16. This axial distance may correspond to approximately 0.5-times to 2-times, furthermore to approximately 1-times, the material thickness of such a receptacle wall 16.

Figure 20:
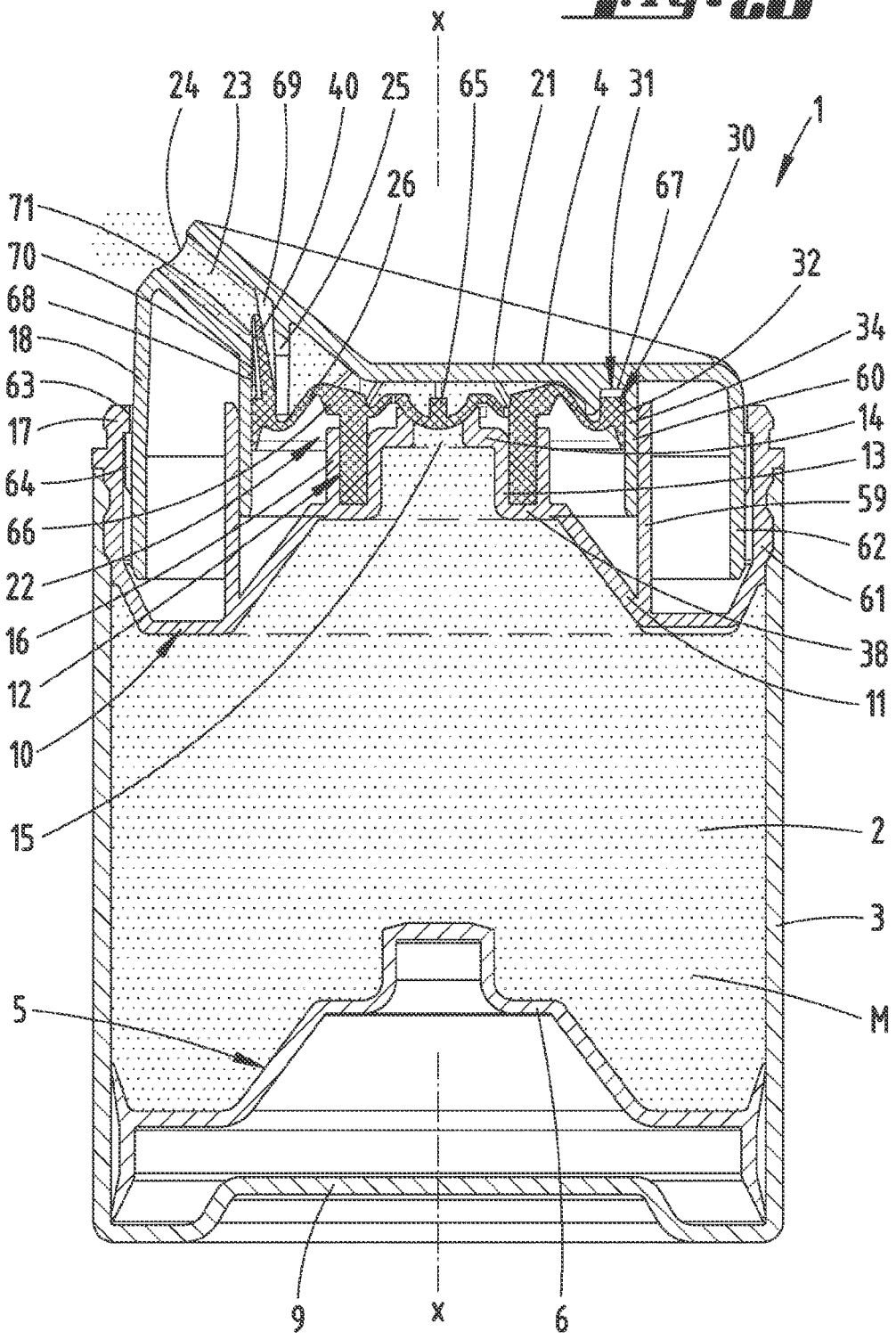
FIG. 20 shows the embodiment according to FIG. 18 in the actuation position.

The bead 66 makes it possible to achieve an increased rigidity in this transition area from the plug projection 38 into the leg 26 such that bending of the leg 26 upon an actuation of the head piece 4 according to FIG. 20 preferably can only start to occur in a region that connects to the bead 66 on the radially outer side. The bending region is purposefully positioned into the thin-walled region formed by the leg 26.

The examples illustrated in FIGS. 13 to 22 furthermore show that the projection base 35 of the retaining projection 30 may with respect to its end face, which is directed upward at the ceiling section 21, be axially spaced apart from the facing groove base 67 of the groove 32 in the retaining receptacle 31. This axial distance may correspond to approximately 0.5-times to 2-times, furthermore to approximately 1-times, the above-described axial distance between the bead 66 and the receptacle wall 16, e.g. to approximately the material thickness of the second cylinder section 60 that delimits the groove 32 on the radially outer side.

According to a potential embodiment, this axial distance may be realized by means of ribs, which are formed over the circumference on the groove base 67 in an isolated manner and on which the projection base 35 abuts in the course of the assembly. In this way, a defined abutment of the projection base 35 in the retaining receptacle 31 can be achieved. This makes it possible to compensate potential irregularities, e.g., as a result of air inclusion between the abutting surfaces.

The outlet opening 25, which is closed in the unloaded starting position, may also be formed by a U-opening, the edge of which is open downward in the direction of the leg 26 (compare particularly to FIGS. 18 and 20) such that an additionally improved flow-through of the compound can be achieved during a dispenser actuation.

According to the fifth embodiment illustrated in FIGS. 18 to 22, the recess 68 for accommodating the tab-like valve section 40, which essentially is aligned in the direction of the central longitudinal axis x and transforms into the discharge channel 23, may starting from the retaining receptacle 31 extend beyond the region of the discharge channel 23 and at the same time form an exposed protrusions 69.

The recess 68, which during an actuation of the head piece 4 is formed behind the valve section 40 viewed in the pivoting direction of the valve section 40, may also be enlarged in comparison with the previously described exemplary embodiments in such a way that an evasion space 70 for the valve section 40 is formed. This can provide the valve section 40 with sufficient pivotability and at the same time limit its pivoting movement.

Figure 21:
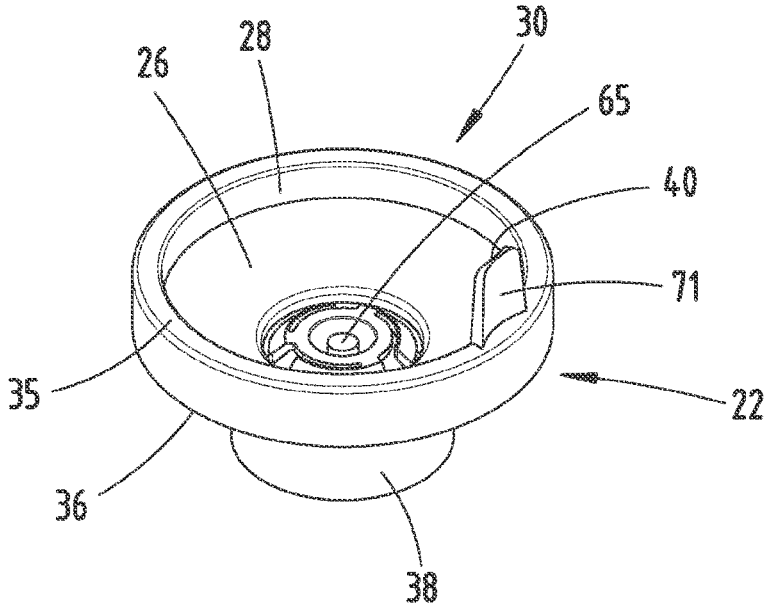
FIG. 21 shows an individual perspective view of the spring element of the fifth embodiment.
Figure 22:
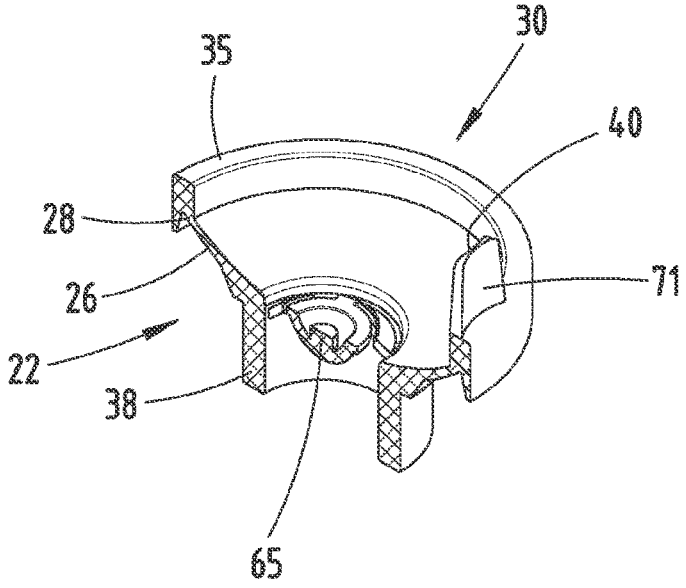
FIG. 22 shows a perspective sectional view of the spring element of the fifth embodiment.

The perspective illustrations in FIGS. 21 and 22, in particular, furthermore show that another design of the valve section 40 may on its radially outer side have a concave profile 71, which accordingly faces the discharge channel 23, such that an advantageous pivoting and spring characteristic, as well as an additionally increased stability, of the valve section 40 can altogether be achieved.

Figure 23:
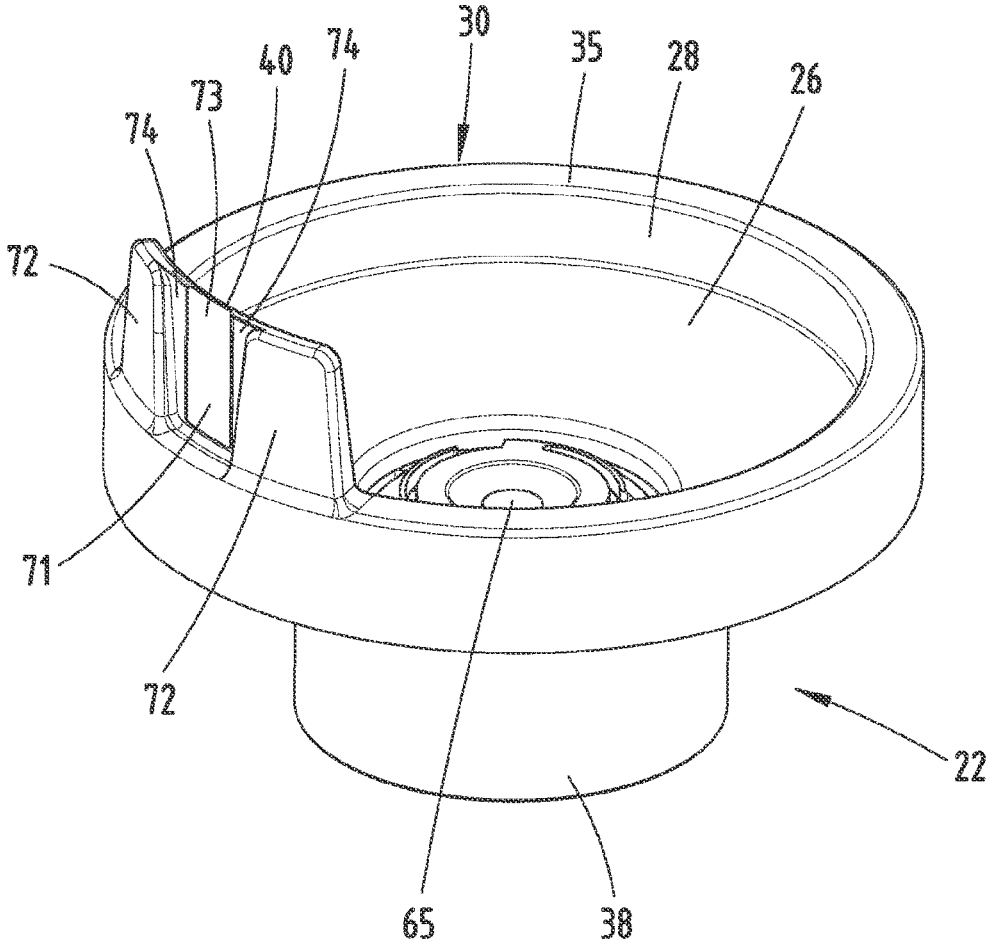
FIG. 23 shows a perspective view of the spring element concerning a sixth embodiment.

According to the alternative embodiment illustrated in FIG. 23, the valve section 40 may viewed in the circumferential direction have a central, relatively thin-walled tab section 73, which on both circumferential sides is flanked by rib sections 72 that are comparatively thick-walled in the radial direction—referred to the central longitudinal axis x. The thickness of the rib section 72 may correspond to approximately 3-times to 5-times, furthermore to approximately 4-times, the thickness of the tab section 73 viewed in the same direction.

A transition section 74, the thickness of which is reduced in comparison with the adjacent rib section 72, may be formed between the rib sections 72 and the tab section 73 in the circumferential direction, wherein the thickness of said transition section may correspond to approximately half the thickness dimension of the rib section 72 and furthermore to approximately twice the thickness dimension of the tab section 73.

An advantageous pivotability and at the same time a sufficiently high stability, particularly in the closed valve position, can also be achieved as a result of this tab design. During a dispenser actuation, a thusly designed valve section 40 optionally can only pivot in the opening direction of the valve in the region of the central tab section 73. In this case, the rib sections 72 on the edge optionally can abut on the above-described protrusion 69. Alternatively or additionally, the thick-walled rib section 72 may also pivot into the open valve position together with the central thin-walled tab section 73—and optionally together with the transition section 74—during a dispenser actuation, but optionally over a smaller pivoting angle than the central tab section 73 and/or the transition section 74—e.g. as a result of a pivoting limitation of the rib sections 72 that engage into the protrusion 69 allowing a limited pivoting movement.

The preceding explanations serve for elucidating all inventions that are included in this application and respectively enhance the prior art independently with at least the following combinations of characteristics, wherein two, multiple or all of these combinations of characteristics may also be combined with one another, namely:

A dispenser 1, which is characterized in that the retaining profile is realized in the form of an altogether annular retaining projection 30, which in terms of cross section is larger than the leg 26 and has an upper projection base 35 that lies in the retaining receptacle 31 and has a closed cross section.

A dispenser 1, which is characterized in that the transition area U has a hinge-like taper 37.

A dispenser 1, which is characterized in that the retaining projection 30 forms a projection leg 36, which with respect to a transition area U between the upward leg 28 and the retaining projection 30 protrudes vertically downward and with respect to the central longitudinal axis x of the dispenser 1 extends radially outward to the upward leg 28 starting from the transition area U.

A dispenser 1, which is characterized in that the retaining receptacle 31 of the head piece 4 for accommodating the retaining projection 30 is realized in the form of a groove 32 that is open vertically downward.

A dispenser 1, which is characterized in that the retaining projection 30 extends vertically upward starting from the transition area U.

A dispenser 1, which is characterized in that the retaining projection 30 engages into the circumferential groove 32 of the head piece 4, which is open vertically downward.

A dispenser 1, which is characterized in that the groove 32 has with respect to a cross section 2 sidewalls 20, 34 of different lengths in the vertical direction.

A dispenser 1, which is characterized in that the radially inner sidewall 20 referred to the central longitudinal axis x is realized shorter than the radially outer sidewall 34.

A dispenser 1, which is characterized in that the radially outer sidewall 34 protrudes vertically downward beyond the projection leg 36.

A dispenser 1, which is characterized in that the radially inner sidewall 20 ends with respect to its vertical extent in the transition area U.

A dispenser 1, which is characterized in that a radially measured wall thickness c of the plug projection 38 corresponds to at least 1.5-times the greatest thickness d in the region of the horizontally extending leg 26.

A dispenser 1, which is characterized in that an axial length e of the plug projection 38 starting from a lower edge 39 of the horizontally extending leg 26 is in the starting position equal to or greater than the axial extent f of the spring element from the aforementioned lower edge 39 of the horizontally extending leg 26 to the axially upper end of the retaining projection 30.

A dispenser 1, which is characterized in that a valve section 40 is integrally formed on the retaining projection 30 in order to realize the outlet valve 41.

A dispenser 1, which is characterized in that the valve section 40 is realized over a greater circumferential section of the retaining projection 30 than that corresponding to a circumferentially greatest clear opening dimension of an outlet opening of the discharge channel 23 adjacent to the retaining projection 30.

A dispenser 1, which is characterized in that the valve section 40 extends over one-third or more of the circumference of the retaining projection 30.

A dispenser 1, which is characterized in that the valve section 40 is designed such that it extends annularly over the circumference in a uniform and closed manner.

A dispenser 1, which is characterized in that a groove 46 for accommodating the valve section 40 in the circumferential direction outside the discharge channel 23 is formed in the head piece 4.

A dispenser 1, which is characterized in that the retaining projection 30 interacts with a lip section 53 of the head piece 4 in order to realize the outlet valve 41.

A dispenser 1, which is characterized in that the lip section 53 extends with respect to the cross section radially outward in a freely protruding manner starting from a radially inner retaining region 56.

A dispenser 1, which is characterized in that the lip section 53 is designed such that it essentially extends horizontally in the cross section.

A dispenser 1, which is characterized in that the lip section 53 interacts with a supporting surface 51 of the retaining projection 30, which is exposed vertically upward.

A dispenser 1, which is characterized in that an annular projection 52, on which the lip section 53 lies in a sealing manner, is formed on the supporting surface 51.

A dispenser 1, which is characterized in that the lip section 53 is formed on a plug part 54 arranged in the head piece 4.

A dispenser 1, which is characterized in that the lip section 53 transforms radially inward into a circumferential ring section 57, which with respect to the cross section protrudes vertically downward beyond the lip section 53.

A dispenser 1, which is characterized in that the lip section 53 and/or the plug part of 54 consist of a rigid plastic.

A dispenser 1, which is characterized in that the horizontally extending leg 26 furthermore is realized integrally with the inlet valve 43.

A dispenser 1, which is characterized in that the head piece 4 is guided in a stop-limited manner on an insert part facing the storage volume 2.

A dispenser 1, which is characterized in that a guidance and a stop limitation are assigned to different components of the head piece 4 and the insert part 10.

A dispenser 1, which is characterized in that the insert part 10 has a first cylinder section 59, which interacts with a second cylinder section 60 of the head piece 4 in order to realize the guidance.

A dispenser 1, which is characterized in that the insert part 10 has a third cylinder section 61, which also serves for producing a snap-in connection with the storage volume 2 and interacts with a fourth cylinder section 62 of the head piece 4 in order to realize the stop limitation.

All disclosed characteristics are essential to the invention (individually, but also in combination with one another). The disclosure of the associated/attached priority documents (copy of the priority application) is hereby fully incorporated into the disclosure content of this application, namely also for the purpose of integrating characteristics of these documents into claims of the present application. The characteristics of the dependent claims also characterize independent inventive enhancements of the prior art without the characteristics of a claim to which they refer, particularly for submitting divisional applications on the basis of these claims. The invention specified in each claim may additionally comprise one or more of the characteristics that were disclosed in the preceding description and, in particular, are identified by reference symbols and/or included in the list of reference symbols. The invention also concerns design variations, in which individual characteristics cited in the preceding description are not realized, particularly as far as they are obviously dispensable for the respective intended use or can be replaced with other, identically acting technical means.

LIST OF REFERENCE SYMBOLS

1 Dispenser
2 Storage volume
3 Compound container
4 Head piece
5 Delimiting part
6 Follower piston
7 Bag
8 Closing cap
9 Housing bottom
10 Insert part
11 Conical region
12 Plug receptacle
13 Pot wall
14 Pot ceiling
15 Inlet opening
16 Receptacle wall
17 Vertical collar
18 Annular wall section
19 Discharge chamber
20 Sidewall
21 Ceiling section
22 Spring element
23 Discharge channel
24 Discharge opening
25 Outlet opening
26 Leg
27 Curvature
28 Upward leg
29 Delimiting wall
30 Retaining projection
31 Retaining receptacle
32 Groove
33 Groove ceiling
34 Sidewall
35 Projection base
36 Projection leg
37 Taper
38 Plug projection
39 Lower edge
40 Valve section
41 Outlet valve

42 Valve plug
43 Inlet valve
44 Opening
45 Web
46 Groove
47 Base section
48 Rip
49 Rib
50 Actuating surface
51 Supporting surface
52 Projection
53 Lip section
54 Plug part
55 Plug part wall
56 Retaining region
57 Ring section
58 Annular space
59 First cylinder section
60 Second cylinder section
61 Third cylinder section
62 Fourth cylinder section
63 Stop projection
64 Mating stop
65 Pin
66 Bead
67 Groove base
68 Recess
69 Protrusion
70 Evasion space
71 Profile
72 Rib section
73 Tab section
74 Transition section
a Length
b Length
c Wall thickness
d Thickness
e Length
f Length
x Central longitudinal axis
E Opening plane
M Compound
U Transition area

The invention claimed is:

1. A dispenser (1) for pasty compounds (M) comprising:

a storage volume (2) with a delimiting part (5), which is configured to be moved conjointly when drawing from the storage volume (2), a head piece (4) that is guided relative to the storage volume (2), a discharge chamber (19) with an inlet valve (43) and an outlet valve (41), the discharge chamber being formed between the head piece (4) and the storage volume (2), a discharge channel (23) with a discharge opening (24), the discharge channel being assigned to the discharge chamber (19), and a spring element (22), which acts between the storage volume (2) and the head piece (4) and at the same time forms part of a delimiting wall (29) of the discharge chamber (19), the spring element being configured to resiliently return the head piece (4) upon a movement from a starting position into an actuation position, wherein said spring element has, viewed in a cross section in which the head piece (4) is arranged vertically on a top and the storage volume (2) is arranged vertically on a bottom and a central longitudinal axis (x) of the dispenser (1) is illustrated in the form of a line, a lower tubular plug projection (38), which is accommodated in a conformingly shaped plug receptacle (12) connecting to the storage volume (2) in a sealed manner, and an upper retaining profile in the form of an altogether annular retaining projection (30), which is accommodated in a retaining receptacle (31) of the head piece (4) in a sealed manner, wherein the spring element (22) is in the form of a leg (26), if the spring element (22) is designed integrally with the retaining projection (30) and the plug projection (38), referred to the cross section in the starting position, wherein the leg is designed so as to connect to the plug projection (38) and transforms into the retaining projection (30) via an upwardly directed curvature (27), wherein the retaining projection (30) has a cross section that is larger than the leg (26) and has an upper projection base (35) that lies in the retaining receptacle (31) and has a closed cross section, wherein a valve section (40) is integrally formed on the retaining projection (30) in order to realize the outlet valve (41), and wherein the valve section (40) has a concave profile (71) on a radially outer side of the valve section facing the discharge channel (23).

2. The dispenser (1) according to claim 1, wherein a radially measured wall thickness (c) of the plug projection (38) corresponds to at least 1.5-times the greatest thickness (d) in the region of the horizontally extending leg (26).

3. The dispenser (1) according to claim 2, wherein an axial length (e) of the plug projection (38) starting from a lower edge (39) of the horizontally extending leg (26) is in the starting position equal to or greater than an axial extent (f) of the spring element (22) from the lower edge (39) of the leg (26) to an axially upper end of the retaining projection (30).

4. The dispenser (1) according to claim 1, wherein the valve section (40) is realized over a greater circumferential section of the retaining projection (30) than that corresponding to a circumferentially greatest clear opening dimension of an outlet opening of the discharge channel (23) adjacent to the retaining projection (30).

5. The dispenser (1) according to claim 4, wherein the valve section (40) extends over one-third or more of a circumference of the retaining projection (30).

6. The dispenser (1) according to claim 5, wherein the valve section (40) is designed to extend annularly over the circumference in a uniform and closed manner.

7. The dispenser (1) according to claim 1, wherein a groove (46) for accommodating the valve section (40) in a circumferential direction outside the discharge channel (23) is formed in the head piece (4).

8. The dispenser (1) according to claim 1, wherein the leg (26) extends horizontally and is formed integrally with the inlet valve (43).

9. The dispenser (1) according to claim 1, wherein the head piece (4) is guided in a stop-limited manner on an insert part (10) facing the storage volume (2).

10. The dispenser (1) according to claim 9, wherein a guidance and a stop limitation are assigned to different components of the head piece (4) and the insert part (10).

11. The dispenser (1) according to claim 10, wherein the insert part (10) has a first cylinder section (59), which interacts with a second cylinder section (60) of the head piece (4) in order to realize the guidance.

12. The dispenser (1) according to claim 10, wherein the insert part (10) has a third cylinder section (61), which also serves for producing a snap-in connection with the storage volume (2) and interacts with a fourth cylinder section (62) of the head piece (4) in order to realize the stop limitation.

13. A dispenser (1) for pasty compounds (M) comprising:

a storage volume (2) with a delimiting part (5), which is configured to be moved conjointly when drawing from the storage volume (2), a head piece (4) that is guided relative to the storage volume (2), a discharge chamber (19) with an inlet valve (43) and an outlet valve (41), the discharge chamber being formed between the head piece (4) and the storage volume (2), a discharge channel (23) with a discharge opening (24), the discharge channel being assigned to the discharge chamber (19), and a spring element (22), which acts between the storage volume (2) and the head piece (4) and at the same time forms part of a delimiting wall (29) of the discharge chamber (19), the spring element being configured to resiliently return the head piece (4) upon a movement from a starting position into an actuation position, wherein said spring element has, viewed in a cross section in which the head piece (4) is arranged vertically on a top and the storage volume (2) is arranged vertically on a bottom and a central longitudinal axis (x) of the dispenser (1) is illustrated in the form of a line, a lower tubular plug projection (38), which is accommodated in a conformingly shaped plug receptacle (12) connecting to the storage volume (2) in a sealed manner, and an upper retaining profile in the form of an altogether annular retaining projection (30), which is accommodated in a retaining receptacle (31) of the head piece (4) in a sealed manner, wherein the spring element (22) is in the form of a leg (26), if the spring element (22) is designed integrally with the retaining projection (30) and the plug projection (38), referred to the cited cross section in the starting position, the leg being designed so as to connect to the plug projection (38) and transforms into the retaining projection (30) via an upwardly directed curvature (27), wherein the retaining projection (30) has a cross section that is larger than the leg (26) and has an upper projection base (35) that lies in the retaining receptacle (31) and has a closed cross section, wherein the retaining receptacle (31) of the head piece (4) for accommodating the retaining projection (30) is in the form of a groove (32) that is open vertically downward, wherein the retaining projection (30) engages into the groove (32) of the head piece (4), which is open vertically downward, and wherein the projection base (35) of the retaining projection (30) is axially spaced apart from a facing groove base (67) of the groove (32) with respect to an end face of the projection base (35) that is directed upward at a ceiling section (21).

14. The dispenser (1) according to claim 13, wherein the retaining projection (30) interacts with a lip section (53) of the head piece (4) in order to realize the outlet valve (41).

15. The dispenser (1) according to claim 14, wherein the lip section (53) extends with respect to the cross section radially outward in a freely protruding manner starting from a radially inner retaining region (56).

16. The dispenser (1) according to claim 15, wherein the lip section (53) is designed to essentially extend horizontally in the cross section.

17. The dispenser (1) according to claim 14, wherein the lip section (53) interacts with a supporting surface (51) of the retaining projection (30), which is exposed vertically upward.

18. The dispenser (1) according to claim 17, wherein an annular projection (52), on which the lip section (53) lies in a sealing manner, is formed on the supporting surface (51).

19. The dispenser (1) according to claim 14, wherein the lip section (53) is formed on a plug part (54) arranged in the head piece (4).

20. The dispenser (1) according to claim 14, wherein the lip section (53) transforms radially inward into a circumferential ring section (57), which with respect to the cross section protrudes vertically downward beyond the lip section (53).

21. The dispenser (1) according to claim 14, wherein the lip section (53) and/or the plug part of (54) consist of a rigid plastic.

22. A dispenser (1) for pasty compounds (M) comprising:

a storage volume (2) with a delimiting part (5), which is configured to be moved conjointly when drawing from the storage volume (2), a head piece (4) that is guided relative to the storage volume (2), a discharge chamber (19) with an inlet valve (43) and an outlet valve (41), the discharge chamber formed between the head piece (4) and the storage volume (2), a discharge channel (23) with a discharge opening (24), the discharge channel being assigned to the discharge chamber (19), and a spring element (22), which acts between the storage volume (2) and the head piece (4) and at the same time forms part of a delimiting wall (29) of the discharge chamber (19), the spring element being configured to resiliently return the head piece (4) upon a movement from a starting position into an actuation position, wherein said spring element has, viewed in a cross section in which the head piece (4) is arranged vertically on a top and the storage volume (2) is arranged vertically on a bottom and a central longitudinal axis (x) of the dispenser (1) is illustrated in the form of a line, a lower tubular plug projection (38), which is accommodated in a conformingly shaped plug receptacle (12) connecting to the storage volume (2) in a sealed manner, and an upper retaining profile in the form of an altogether annular retaining projection (30), which is accommodated in a retaining receptacle (31) of the head piece (4) in a sealed manner, wherein the spring element (22) is in the form of a leg (26), if the spring element (22) is designed integrally with the retaining projection (30) and the plug projection (38), referred to the cited cross section in the starting position, wherein the leg (26) is designed so as to connect to the plug projection (38) and transforms into the retaining projection (30) via an upwardly directed curvature (27), wherein the retaining projection (30) has a cross section that is larger than the leg (26) and has an upper projection base (35) that lies in the retaining receptacle (31) and has a closed cross section, and wherein the leg (26) transforms into the retaining projection (30) via a hinge-like taper (37).

23. A dispenser (1) for pasty compounds (M) comprising:

a storage volume (2) with a delimiting part (5), which is configured to be moved conjointly when drawing from the storage volume (2), a head piece (4) that is guided relative to the storage volume (2), a discharge chamber (19) with an inlet valve (43) and an outlet valve (41) formed between the head piece (4) and the storage volume (2), a discharge channel (23) with a discharge opening (24), the discharge channel being assigned to the discharge chamber (19), a spring element (22), which acts between the storage volume (2) and the head piece (4) and at the same time forms part of a delimiting wall (29) of the discharge chamber (19), the spring element being configured to resiliently return the head piece (4) upon a movement from a starting position into an actuation position, wherein said spring element has, viewed in a cross section in which the head piece (4) is arranged vertically on a top and the storage volume (2) is arranged vertically on a bottom and a central longitudinal axis (x) of the dispenser (1) is illustrated in the form of a line, a lower tubular plug projection (38), which is accommodated in a conformingly shaped plug receptacle (12) connecting to the storage volume (2) in a sealed manner, and an upper retaining profile in the form of an altogether annular retaining projection (30), which is accommodated in a retaining receptacle (31) of the head piece (4) in a sealed manner, wherein the spring element (22) is in the form of a leg (26), if the spring element (22) is designed integrally with the retaining projection (30) and the plug projection (38), referred to the cited cross section in the starting position, wherein the leg is designed so as to connect to the plug projection (38) and transforms into the retaining projection (30) via an upwardly directed curvature (27), wherein the retaining projection (30) has a cross section that is larger than the leg (26) and has an upper projection base (35) that lies in the retaining receptacle (31) and has a closed cross section, and wherein the retaining projection (30) forms a projection leg (36), which with respect to a transition area (U) between the upward leg (28) and the retaining projection (30) protrudes vertically downward and with respect to the central longitudinal axis (x) of the dispenser (1) extends radially outward to the upward leg (28) starting from the transition area (U).

24. The dispenser (1) according to claim 23, wherein the retaining projection (30) extends vertically upward starting from the transition area (U).

25. The dispenser (1) according to claim 23, wherein the groove (32) has with respect to a cross section (2) sidewalls (20, 34) of different lengths in the vertical direction.

26. The dispenser (1) according to claim 25, wherein the radially inner sidewall (20) referred to the central longitudinal axis (x) is shorter than the radially outer sidewall (34).

27. The dispenser (1) according to claim 23, wherein the radially outer sidewall (34) protrudes vertically downward beyond the projection leg (36).

28. The dispenser (1) according to claim 23, wherein a vertical extent of the radially inner sidewall (20) ends in the transition area (U).

* * * * *